US005353604A

United States Patent [19]

Oguni et al.

[11] Patent Number: 5,353,604

[45] Date of Patent: Oct. 11, 1994

[54] REFRIGERATION CYCLE

[75] Inventors: Kensaku Oguni, Shimizu; Kazumoto Urata, Shizuoka; Hiroaki Matsushima, Ryugasaki, all of Japan

[73] Assignee: Hitachi, Ltd., Japan

[21] Appl. No.: 107,155

[22] Filed: Aug. 17, 1993

[30] Foreign Application Priority Data

Aug. 31, 1992 [JP] Japan ..... 4-230868

[51] Int. Cl.[5] ..... F25B 41/00

[52] U.S. Cl. ..... 62/207; 62/502

[58] Field of Search ..... 62/502, 114, 207, 129, 62/126, 228.4

[56] References Cited

U.S. PATENT DOCUMENTS

| | | | |
|---|---|---|---|
| 4,679,403 | 7/1987 | Yoshida et al. | 62/114 |
| 4,722,195 | 2/1988 | Suzuki et al. | 62/149 |
| 4,913,714 | 4/1990 | Ogura et al. | 62/149 |
| 5,009,078 | 4/1991 | Ohkoshi et al. . | |

FOREIGN PATENT DOCUMENTS

| | | | |
|---|---|---|---|
| 0257122 | 6/1988 | Fed. Rep. of Germany | 62/502 |
| 47-27055 | 11/1972 | Japan . | |
| 1-200153 | 8/1989 | Japan . | |
| 1-256765 | 10/1989 | Japan . | |
| 1-305272 | 12/1989 | Japan . | |

*Primary Examiner*—William E. Wayner
*Attorney, Agent, or Firm*—Evenson, McKeown, Edwards & Lenahan

[57] ABSTRACT

The composition of a refrigerant in a refrigeration cycle is detected, so that the refrigeration cycle is controlled by a control method in accordance with the detected composition. A control target value is set in accordance with the detected composition, and when the composition is varied, the control target is changed in accordance with that variation. As a result, even when the refrigerant composition is varied, the refrigeration cycle can be operated stably. The refrigeration cycle uses a non-azeotrope refrigerant, and includes a device for detecting the composition of a non-azeotrope refrigerant; a device for detecting the operating state of the refrigeration cycle, i.e., status values to be controlled, such as temperature or pressure; a computation control apparatus for accepting composition, temperature, pressure or the like, detected by the detecting device as inputs and for performing signal conversion, computation control for control targets, or the like; and a drive apparatus for driving the components of the refrigeration cycle, such as a compressor or a refrigerant pressure reduction apparatus.

17 Claims, 21 Drawing Sheets

REFRIGERATION CYCLE

BACKGROUND OF THE INVENTION

1. Field of the Invention

The present invention relates to a refrigeration cycle and, more particularly, to a control of a refrigeration cycle in which a non-azeotrope refrigerant is used as a working fluid.

2. Description of the Related Art

First, the problem which arises when a non-azeotrope refrigerant is used as a working fluid will be explained. The non-azeotrope refrigerant is a refrigerant in which two or more types of refrigerants having different boiling points are mixed, and has characteristics shown in FIG. 1. FIG. 1 is a vapor-liquid equilibrium diagram illustrating characteristics of a non-azeotrope refrigerant in which two types of refrigerants are mixed. The horizontal axis indicates the composition ratio of a refrigerant having a low boiling point, and the vertical axis indicates temperature. In the diagram pressure is used as a parameter. The composition ratio X=0 indicates that only a high-boiling-point refrigerant exists, and the composition ratio X=1.0 indicates that only a low-boiling-point refrigerant exists. In a mixture refrigerant, as shown in FIG. 1, a saturation liquid line and a saturation vapor line are determined by the composition thereof. The area below the saturation liquid line indicates the supercooled state, and the area above the saturation vapor line indicates the superheated state. The portion surrounded by the saturation liquid line and the saturation vapor line is a two-phase state of liquid and vapor. In FIG. 1, X0 denotes the composition of a refrigerant charged in a refrigeration cycle. Points 1 to 4 indicate the typical points of the refrigeration cycle, and point 1 indicates a compressor outlet portion; point 2 indicates a condenser outlet portion; point 3 indicates an evaporator inlet portion; and point 4 indicates a compressor inlet portion.

An explanation will be given below of problems relating to leakage out of the refrigeration cycle, to variations in the composition of a refrigerant circulating in the refrigeration cycle in a non-steady state such as at the start-up time of the refrigeration cycle, and to operation control of a refrigeration cycle.

The leakage of a refrigerant out of the refrigeration cycle is not none even in a hermetically sealed type air-conditioner or refrigerator. In FIG. 1, point A indicates the two-phase portion in the refrigeration cycle, in which the liquid of composition Xa1 and the vapor of composition Xa2 exist. In the case that the refrigerant leaks out of a heat-transfer tube of a heat exchanger or from a connection tube of a component, the leaked refrigerant would be a refrigerant of composition Xa1 in the case of liquid leakage, and a refrigerant of composition Xa2 in the case of vapor leakage. Therefore, the composition of the refrigerant remaining within the refrigeration cycle differs depending upon whether liquid or vapor leaks.

FIG. 2 is an illustration of a problem caused by the leakage of a refrigerant to the outside. If liquid leaks, the remaining mixture refrigerant enters the state of X1 in which the ratio of a low boiling-point refrigerant is large; if vapor leaks, the remaining mixture refrigerant enters the state of X2 in which the ratio of a high boiling-point refrigerant is large. In FIG. 2, X0 indicates the composition of a refrigerant which is sealed in initially. Comparing a state having the composition ratio of X0 with a state having the composition ratio of X1 under the same pressure, the temperature in the state having the composition ratio of X1 is lower. Comparing a state having the composition ratio of X0 with a state having the composition ratio of X2 under the same pressure, the temperature in the state having the composition ratio of X2 is higher.

FIG. 3 shows general characteristics of a refrigeration cycle with respect to the composition ratio of the low boiling-point refrigerant. When the low boiling-point refrigerant composition ratio X becomes larger than the designed composition X0, the discharge pressure and the intake pressure become higher, and therefore capacity improves. In contrast, when the low boiling-point refrigerant composition ratio X becomes smaller than the designed composition X0, the discharge pressure and the intake pressure become lower, therefore capacity deteriorates.

Next, the problem in a non-steady state such as at the start of the refrigeration cycle will be explained. FIG. 4 illustrates the construction of the refrigeration cycle. Referring to FIG. 4, reference numeral 1 denotes a compressor; reference numeral 2 denotes a four-way valve; reference numeral 3 denotes a heat-source side heat exchanger; reference numeral 4 denotes a refrigerant pressure reducing apparatus; reference numeral 5 denotes an accumulator; and reference numeral 6 denotes a use-side heat exchanger. A non-azeotrope refrigerant is charged in. In FIG. 4, the refrigerant circulates in the direction of the solid-line arrow during the cooling operation, and circulates in the direction of the dashed line arrow during the heating operation. The pressure when the refrigeration cycle shown in FIG. 4 is started, and changes in the compositions of the circulating refrigerant are shown in FIG. 5. When the refrigeration cycle is started, the low-pressure side pressure decreases. This pressure reduction causes the low boiling-point refrigerant to be gasified from the liquid refrigerant remaining in the accumulator or the like, and the circulating refrigerant reaches a state in which the composition ratio of the low boiling-point refrigerant is large. When the composition ratio of the low boiling-point refrigerant becomes large as described above, both the discharge and intake pressures become higher, and the discharge pressure may happen to exceed an upper-limit value.

If the refrigerant leaks out of the refrigeration cycle in which a non-azeotrope refrigerant is used as a working fluid, as described above, the composition of the refrigerant remaining within the refrigeration cycle changes from the initial composition, i.e., from the designed composition for the apparatus depending upon leaked portions. Even if there is no leakage to the outside, there is a possibility that the composition of the refrigerant circulating within the refrigeration cycle may vary in the non-steady state of the refrigeration cycle.

Changes in the composition of the refrigerant within the refrigeration cycle cause problems; for example, capacity is varied, or pressure or temperature becomes abnormal. Therefore, the refrigeration cycle must be controlled properly.

Technology described below is available for controlling the refrigeration cycle in which a non-azeotrope refrigerant is used as a working fluid.

Disclosed in Japanese Patent Unexamined Publication No. 1-256765 is technology for making always constant the superheatedness of a refrigerant at an evaporator outlet constituting the refrigeration cycle even if the composition of the refrigerant within the refrigeration cycle varies due to leakage. More specifically, according to the technology proposed, the composition of the refrigerant circulating within the refrigeration cycle is determined by comparing the measured values of the pressure and temperature in a high-pressure liquid portion of the refrigeration cycle with the prestored temperature and pressure characteristics of a non-azeotrope refrigerant. Even in the above determined composition, the superheated degree is always maintained at the superheated degree before the composition is varied.

In another technology disclosed in Japanese Patent Unexamined Publication No. 1-200153, a compressor constituting the refrigeration cycle is a compressor of a variable rotation speed type, a pressure detection mechanism being disposed in the compressor discharge section so that the rotation speed of the compressor is controlled such that the pressure in the discharge section does not exceed a fixed value.

A conventional method of controlling a refrigeration cycle in which a single refrigerant is used is disclosed in Japanese Utility Model Unexamined Publication No. 47-27056, Japanese Patent Unexamined Publication No. 1-305272 and the like. These publications disclose a method of controlling the pressure to be constant.

As described above, in the refrigeration cycle in which a non-azeotrope refrigerant is charged, the composition of the refrigerant within the refrigeration cycle may vary when the refrigerant leaks out of the refrigeration cycle or during the non-steady operation of the refrigeration cycle. Therefore, the refrigeration cycle must be controlled properly in accordance with the composition of the refrigerant.

In connection with this, in the above-described related art, although the superheated degree of the refrigerant in the evaporator outlet of the refrigeration cycle is controlled to be constant even if the composition of the refrigerant is varied, no consideration has been given to the fact that the characteristics to be controlled are varied in accordance with the composition when the composition is varied. Further, although the discharge pressure is controlled so as not to exceed a certain value on the basis of the rotation speed of the compressor, no consideration has been given to the fact that the superheatedness of the refrigerant is controlled in accordance with the composition, for example, by changing the upper limit of the discharge pressure in accordance with the composition.

In the conventional method of controlling the refrigeration cycle in which a single refrigerant is used, as a matter of course, no consideration has been given to the composition of the refrigerant.

SUMMARY OF THE INVENTION

It is an object of the present invention to detect the composition of the refrigerant in the refrigeration cycle in order to control the operating state of the refrigeration cycle by a control method in accordance with the detected composition, to control the operating state of the refrigeration cycle on the basis of the control target values in accordance with the detected composition, to change the control targets in accordance with changes in the composition when the composition is varied, and to obtain a refrigeration cycle which can be operated stably even when the composition of the refrigerant is varied.

To achieve the above object, according to the present invention, the refrigeration cycle comprises a compressor, a heat-source side heat exchanger, a use-side heat exchanger, and a pressure reducing apparatus, a non-azeotrope refrigerant being used as the working fluid. The refrigeration cycle comprises a device for detecting the composition of a non-azeotrope refrigerant in the refrigeration cycle; a device for detecting the operating state of the refrigeration cycle, i.e., status values to be controlled, such as temperature or pressure; a computation control apparatus for accepting the composition, temperature, pressure or the like, detected by the detecting device as inputs and for performing signal conversion, operation control of the control target or the like; and a drive apparatus for driving the components of the refrigeration cycle, such as a compressor or a refrigerant pressure reduction apparatus.

According to the present invention, signals from the device for detecting the composition of the non-azeotrope refrigerant in the refrigeration cycle are input to the computation control apparatus, a control method appropriate for the detected composition and the control target are determined, and instructions are issued to the drive apparatus for driving the components of the refrigeration cycle, such as a compressor or a refrigerant pressure reducing apparatus, on the basis of the control method and the control target. As a result, stable operation becomes possible even if the refrigerant leaks outside and the composition of the refrigerant circulating in the refrigeration cycle is varied from the designed composition of the refrigeration cycle. Also, even when the composition of the refrigerant varies in the non-steady state of the refrigeration cycle, performance and reliability can be ensured.

The above and further objects and novel features of the invention will be more apparent from the following detailed description when the same is read in connection with the accompanying drawings. It is to be expressly understood, however, that the drawings are for the purpose of illustration only and are not intended as a definition of the limits of the invention.

DESCRIPTION OF THE PREFERRED EMBODIMENTS

Preferred embodiments of the present invention will be explained below with reference to the accompanying drawings.

Figure 6:
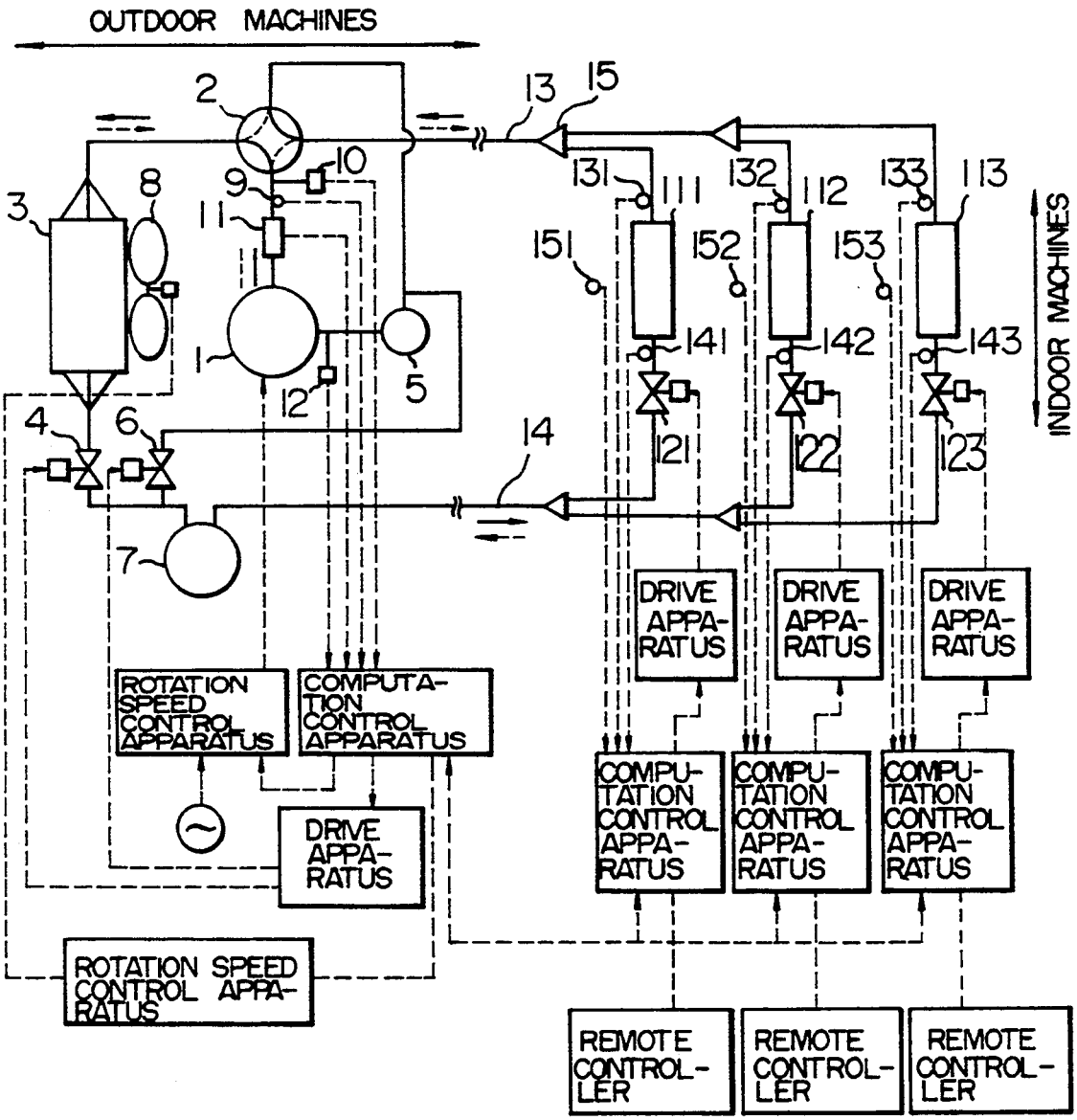
FIG. 6 is an illustration of the construction of the refrigeration cycle in accordance with an embodiment of the present invention, in which a plurality of indoor machines are connected.

FIG. 6 illustrates a refrigeration cycle in which a plurality of indoor machines are connected to one outdoor machine in accordance with an embodiment of the present invention. Referring to FIG. 6, reference numeral 1 denotes a compressor; reference numeral 2 denotes a four-way valve; reference numeral 3 denotes an outdoor heat exchanger; reference numeral 4 denotes an outdoor refrigerant control valve; reference numeral 5 denotes an accumulator; reference numeral 6 denotes a refrigerant control valve for by-passing liquid; reference numeral 7 denotes a receiver; reference numeral 8 denotes an outdoor air blower; reference numeral 9 denotes a temperature sensor disposed on the compressor discharge side; reference numeral 10 denotes a pressure sensor disposed on the compressor discharge side; reference numeral 11 denotes a refrigerant composition sensor; and reference numeral 12 denotes a pressure sensor disposed on the compressor intake side. The refrigerant composition sensor 11 is an electrostatic capacitance type sensor. Reference numerals 13 and 14 denote pipes for connecting indoor machines to outdoor machines; and reference numeral 15 denotes a refrigerant flow divider.

Reference numerals 111, 112 and 113 denote indoor heat exchangers; reference numerals 121, 122 and 123 denote indoor refrigerant control valves; reference numerals 131, 132 and 133 denote indoor heat-exchanger outlet refrigerant temperature sensor during cooling; reference numerals 141, 142 and 143 denote indoor heat-exchanger inlet refrigerant temperature sensor during cooling; reference numerals 151, 152 and 153 denote temperature sensors for detecting indoor air temperature. The illustration of the indoor air blower is omitted.

Next, the control system of the refrigeration cycle will be explained. The outdoor machines include an AD converter for converting signals from a sensor, a computation control apparatus, in which control programs are stored, for controlling computational operations, rotation speed control apparatus for controlling rotation speed of a compressor, a drive apparatus for driving a control valve, and the like. Each of the indoor machines includes an AD converter for converting signals from a sensor, a computation control apparatus, in which control programs are stored, for controlling computational operations, a drive apparatus for driving a control valve, a remote controller, and the like. The computation control apparatus on the indoor machine side is connected to the computation control apparatus on the outdoor machine side by means of signal lines. Signals from the composition sensor 11, the temperature sensor 9 and the pressure sensor 10, which are disposed on the discharge side of the compressor, and from the pressure sensor 12 disposed on the compressor intake side are input to the computation control apparatus. Signals are output from the computation control apparatus to the rotation speed control apparatus and the control valve drive circuit so that the rotation speed of the compressor and the opening of the control valve are controlled. In the indoor machines, signals from the refrigerant inlet temperature sensors 131 and the refrigerant outlet temperature sensor 141 during cooling, and the temperature sensor 151 are input to the computation control apparatus which controls the control valve 121. The remote controller is connected by signal lines to the computation control section.

During the cooling operation, the refrigerant circulates in the direction of the solid-line arrow, and the indoor heat exchanger serves as an evaporator in order to perform cooling. In contrast, during a heating operation, the refrigerant circulates in the direction of the dashed-line arrow, and the indoor heat exchanger serves as a condenser in order to perform heating.

Figure 7:
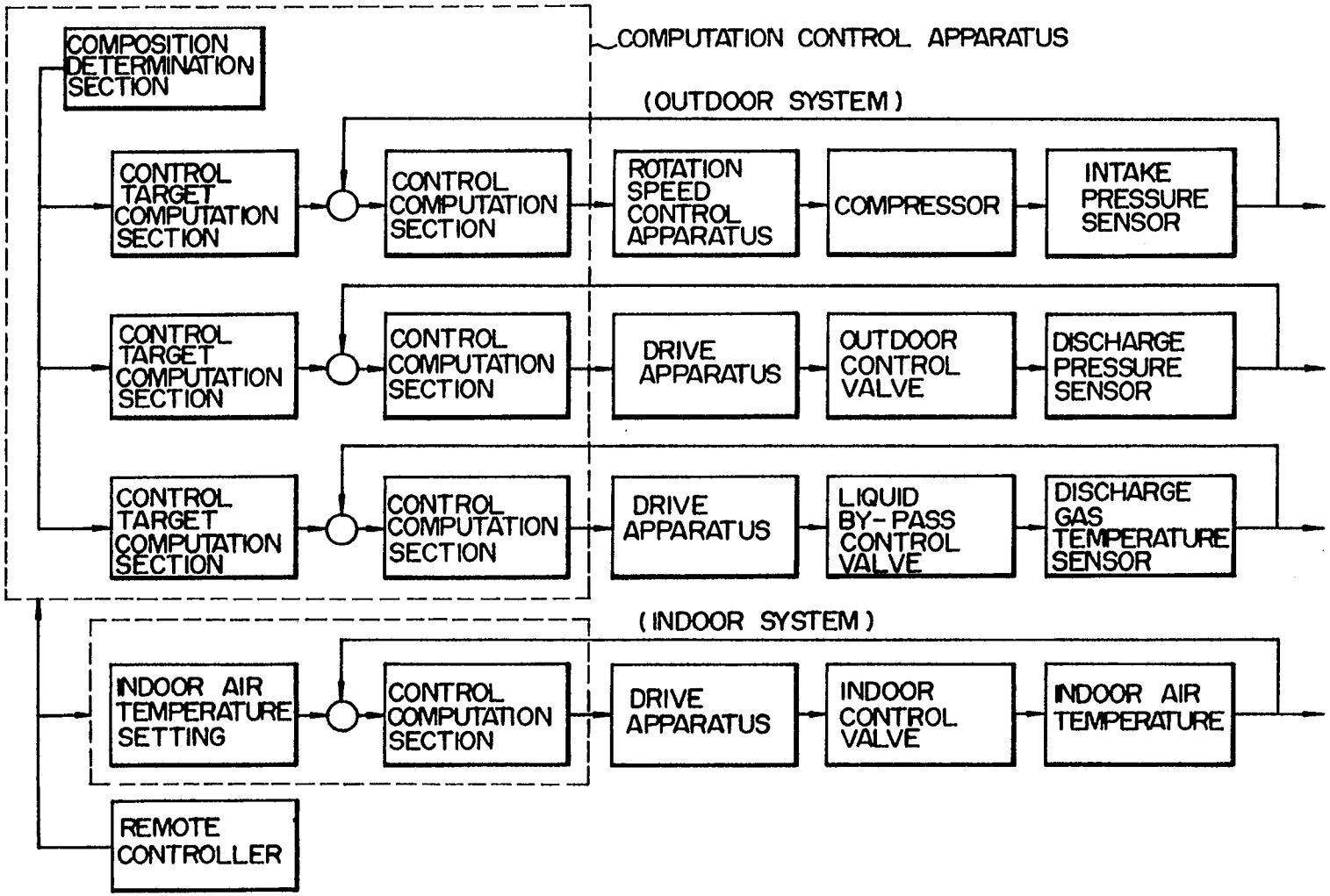
FIG. 7 is a block diagram illustrating an embodiment of a control method in accordance with the present invention.

Next, an embodiment of a control method is illustrated in FIG. 7. The upper portion in FIG. 7 indicates a control block diagram of the indoor machines, and the lower portion in FIG. 7 indicates a control block diagram of outdoor machines. A cooling operation will be explained first. The intake pressure of the compressor 1 is controlled by the rotation speed of the compressor 1. A control target value of the intake pressure of the compressor 1 is determined on the basis of the composition of a circulating refrigerant by executing a prestored program, which is detected by the composition sensor 11. The control computation section computes a correction value for the rotation speed of the compressor 1 on the basis of the difference between the value detected by the intake pressure sensor 12 and the control target value by executing a prestored control program, and sends the value to the rotation speed control apparatus. The compressor 1 is operated in accordance with the rotation speed instructed from the rotation speed control apparatus, and the intake pressure is determined by the characteristics of the refrigeration cycle. For example, if the number of operating indoor machines increases in FIG. 6, the intake pressure increases because the evaporator becomes large for the refrigeration cycle. If the intake pressure becomes higher than the control target value, the rotation speed of the compressor 1 increases, and the intake pressure decreases and stabilizes at the target value.

Next, the control target value of the discharge pressure is also determined by taking the composition of the circulating refrigerant into consideration, and controlled by the outdoor control valve 4. The control computation section computes the opening correction value of the outdoor control valve 4 on the basis of the difference between the value detected by the pressure sensor 10 and the control target value by executing a prestored control program, and sends the value to the drive apparatus. The outdoor control valve 4 is operated by the drive apparatus, and the discharge pressure is determined by the characteristics of the refrigeration cycle. For example, when the outdoor air temperature decreases during of a cooling operation, the discharge pressure decreases. When the discharge pressure decreases than the control target, the opening of the outdoor control valve 4 becomes smaller, the refrigerant remains in the outdoor heat exchanger 3, and the discharge pressure increases and stabilizes at the target value.

Next, the control target value of the discharge gas temperature is also determined by taking the composition of the circulating refrigerant into consideration, and is controlled by the liquid by-pass control valve 6. The control computation section computes an opening correction value of the liquid by-pass control valve 6 on the basis of the difference between the value detected by the discharge gas temperature sensor 9 and the control target value by executing a prestored control program, and sends the value to the drive apparatus. The liquid by-pass control valve 6 is operated by the drive apparatus, and the discharge gas temperature is determined by the characteristics of the refrigeration cycle. For example, when the discharge gas temperature increases, the opening of the liquid by-pass control valve 6 increases, the liquid by-pass amount increases, the intake-side temperature of the compressor 1 decreases, and the discharge temperature also decreases.

Next, in the indoor machines, an opening correction value of the intake control valve 121 is computed on the basis of the difference between the indoor air temperature set value from the remote controller and the temperature detected by the indoor air temperature sensor 151 by executing a prestored control program, and the value is sent out to the drive apparatus. The drive apparatus causes the indoor control valve 121 to operate, the capacity of the indoor heat exchanger 111 changes, and the indoor air temperature stabilizes at the set value.

Figure 8:
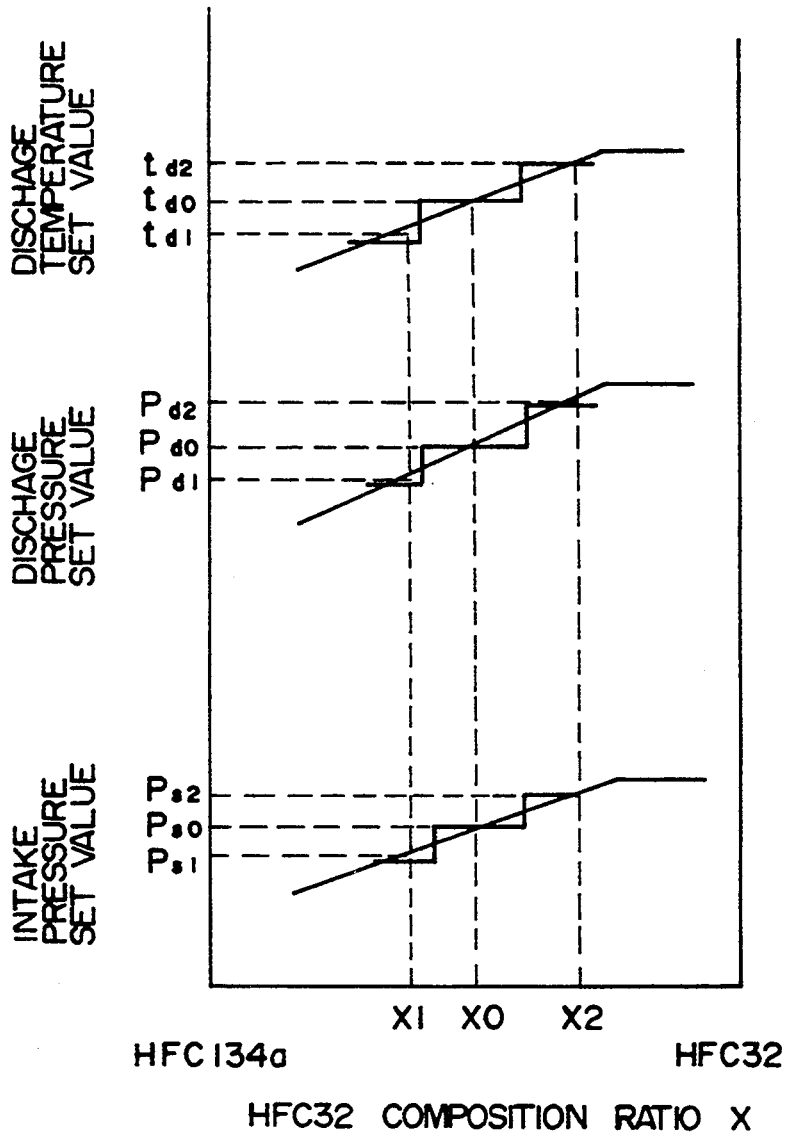
FIG. 8 is a diagram illustrating an example of the relationship between control target values and the composition of a mixture refrigerant in accordance with the present invention.

FIG. 8 shows an embodiment of the relationship between the mixture refrigerant composition stored in the control target computation section and the set values of pressure and temperature. In this embodiment, a mixture refrigerant of two types of refrigerants will be explained. A low boiling-point refrigerant is HFC32, and a high boiling-point refrigerant is HFC134a. The horizontal axis of FIG. 8 indicates a composition ratio X of the low boiling-point refrigerant. X0 indicates a designed composition. A set value of an intake pressure will be explained first. When a liquid refrigerant leaks out of the refrigeration cycle, or when the circulating refrigerant composition varies to X2 with respect to the composition X0 in a non-steady state of the refrigeration cycle, the pressure increases as described above. Therefore, in the intake pressure control method shown in FIG. 7, if the refrigerant composition is not corrected, the number of rotations of the compressor increases, the refrigerant flow rate increases, causing performance to be excessively high and increase in the discharge pressure to increase. Therefore, the larger the composition ratio of the low boiling-point refrigerant is, the larger the set value of the intake pressure must be made, as shown in FIG. 8. However, if the set value is increased immoderately, the compressor may be overloaded. Therefore, as shown in FIG. 8, when X is higher than a certain value, it is also necessary to keep the set value constant.

Figure 1:
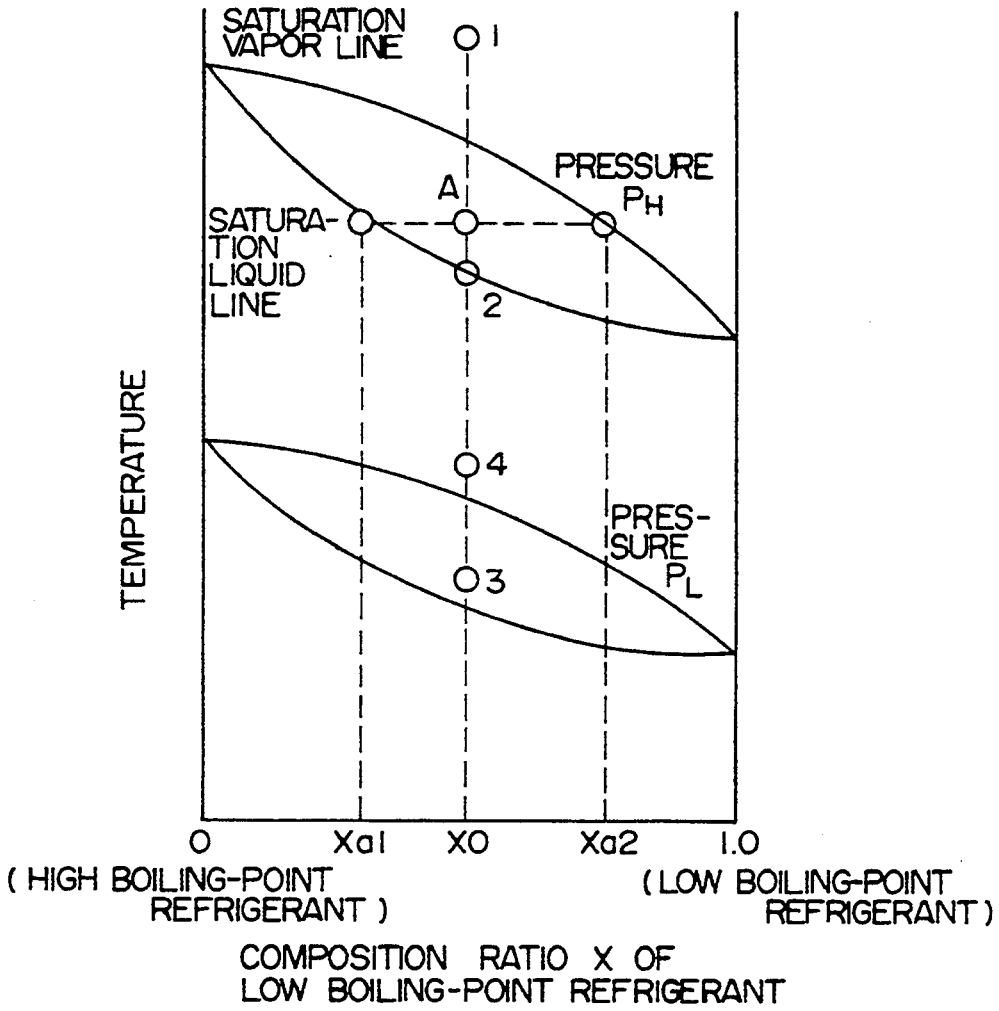
FIG. 1 is a diagram showing the characteristics of a non-azeotrope refrigerant.
Figure 2:
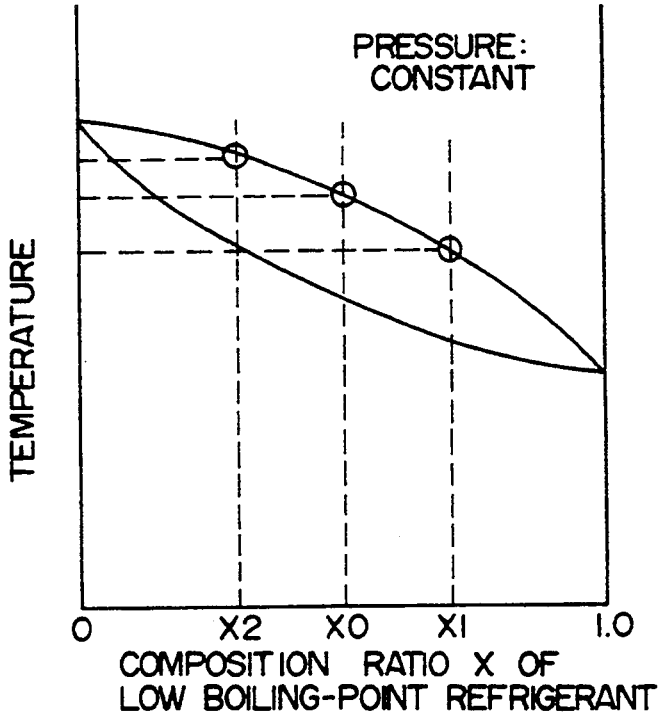
FIG. 2 is a diagram showing the relationship between the composition and temperature of the non-azeotrope refrigerant.
Figure 4:
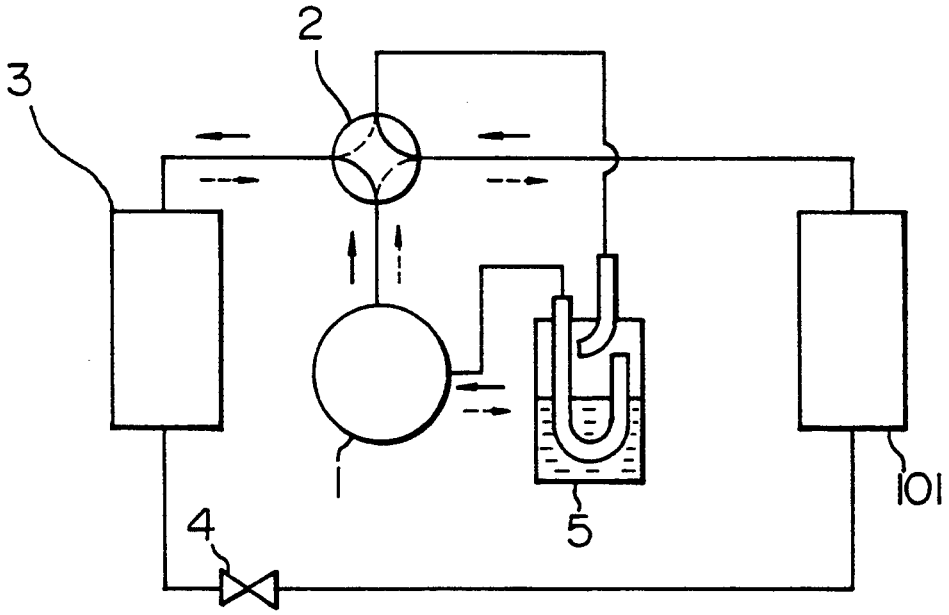
FIG. 4 is an illustration of the construction of the non-azeotrope refrigerant refrigeration cycle.
Figure 3:
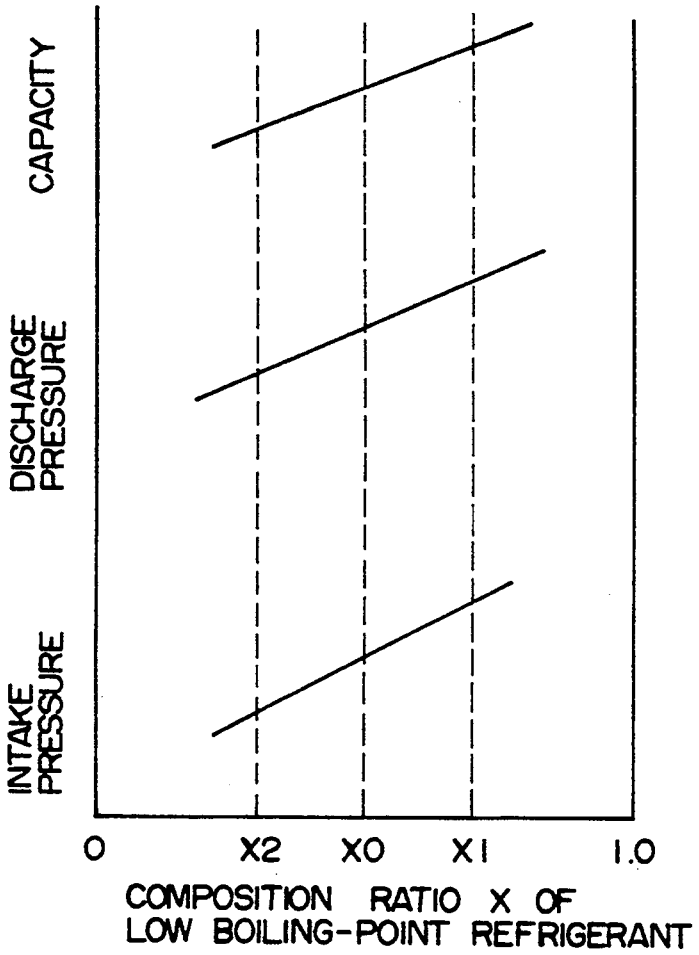
FIG. 3 is a diagram showing the characteristics of a non-azeotrope refrigerant refrigeration cycle.
Figure 5:
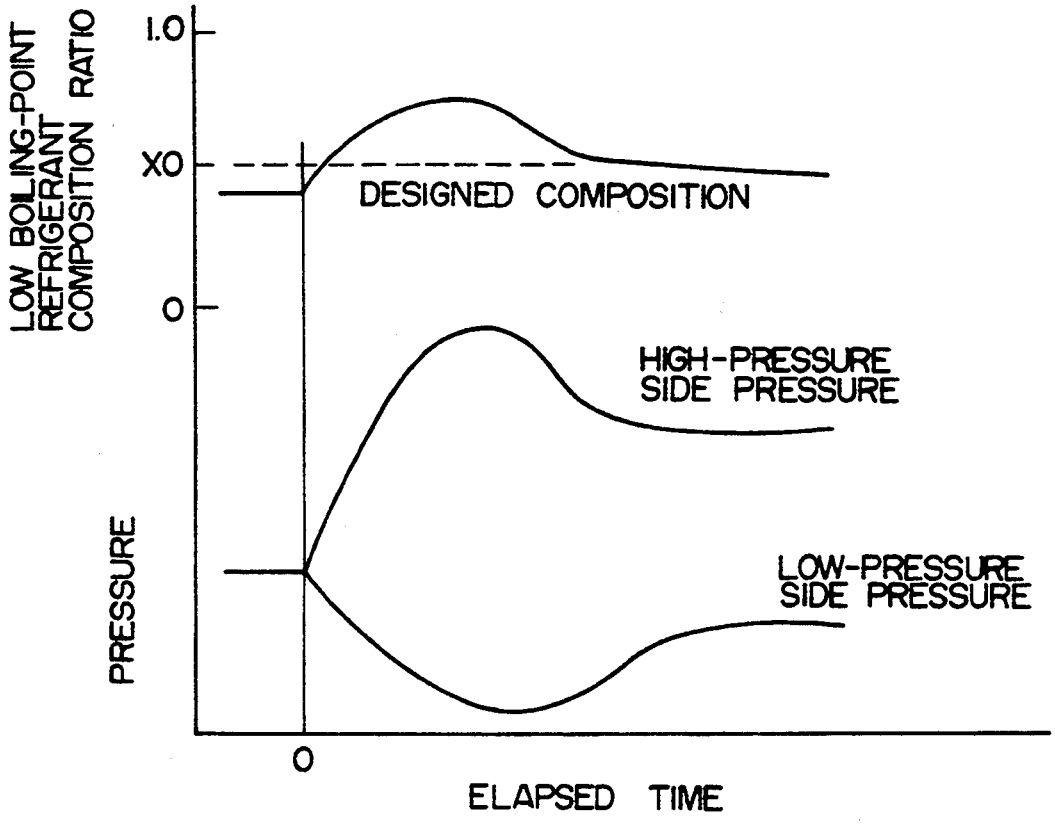
FIG. 5 is a diagram illustrating a problem of the non-azeotrope refrigerant refrigeration cycle.

When, in contrast, the circulating refrigerant composition varies to X1 with respect to composition X0, the pressure decreases as described above. Therefore, in the intake pressure control method shown in FIG. 7, if the refrigerant composition is not corrected, the rotation speed of the compressor decreases and the refrigerant flow rate decreases, causing capacity to deteriorate than required. If the composition ratio of the high boiling-point refrigerant increases, capacity decreases as shown in FIG. 3, causing the rotation speed of the compressor to decrease and capacity to decrease even more. Therefore, the smaller the composition ratio of the low boiling-point refrigerant is, the smaller the set value of the intake pressure must be made. The relationship between the composition ratio and the intake pressure set value may be continuous or step-like, as shown in FIG. 8.

Next, the set value of the compressor discharge gas temperature will be explained. Preferably, the larger the composition ratio of HFC32 is, the higher the discharge gas temperature must be made. However, if the discharge gas temperature is increased immoderately, for example, the temperature of a motor coil of the compressor increases, causing reliability to decrease. Therefore, it is necessary to keep the temperature within a certain temperature.

The composition of the refrigerant may be detected during the operation in the description with reference to FIG. 7. The composition thereof may be detected at an appropriate timing in the entire flow of the control. For example, to increase detection accuracy, if the detected value after a predetermined time has passed from when the refrigeration cycle is started is determined to be a refrigerant composition in the refrigeration cycle, an accurate composition can be obtained. Also, if it is confirmed that an output from the composition sensor has stabilized in point of time and it is determined that the detected value is the refrigerant composition in the refrigeration cycle, an accurate composition can be obtained. It is also possible to detect and determine the composition in a state in which the refrigeration cycle is stopped. Furthermore, to increase detection accuracy in the non-steady state, the composition may preferably be corrected on the basis of the detected values such as pressure or temperature, or a passed time. Although the designed composition is denoted as X0 in FIG. 8, it is possible to prestore this X0 in a composition conversion section. It is also possible to determine that the composition has varied by a method wherein the composition immediately after the refrigeration cycle is operated, that is, the initial composition, is stored as a reference composition, and the composition is compared with a composition which will be detected later.

Next, the control computation section will be explained. The control computation section has prestored control programs therein. Control programs include a PID algorithm, a fuzzy control method and the like. However, the control programs are not particularly limited to these examples.

Figure 9:
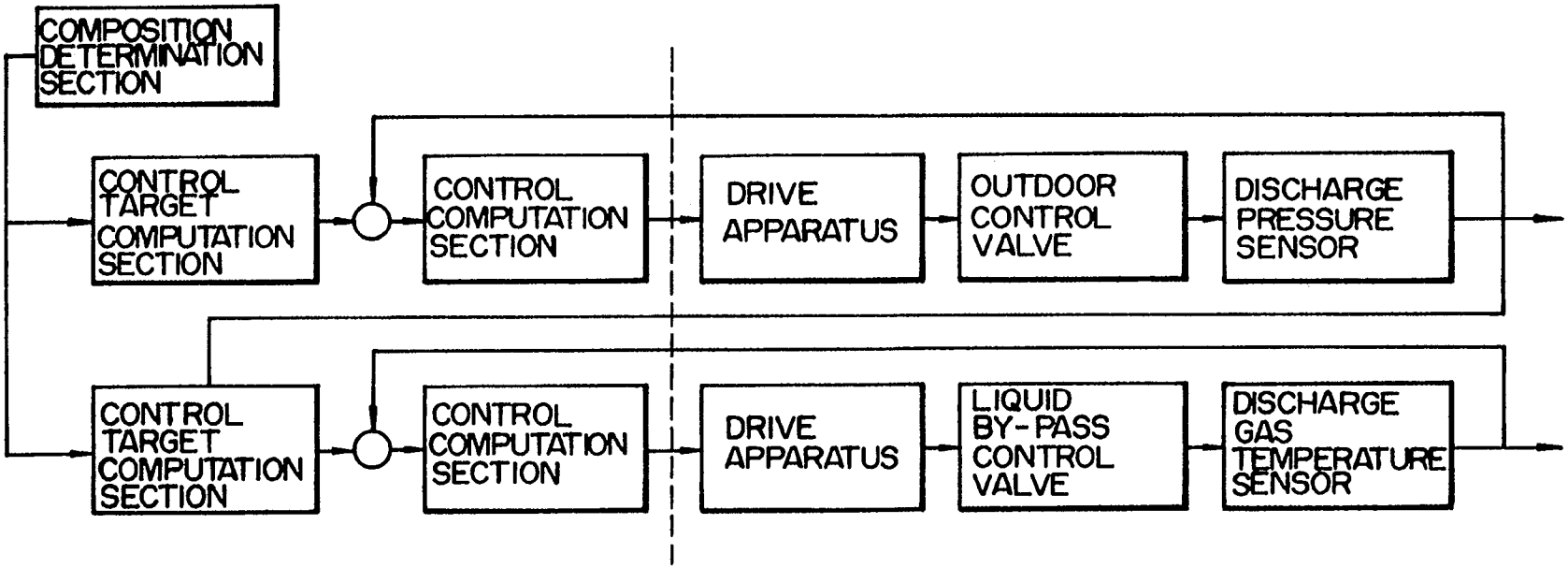
FIG. 9 is a control block diagram illustrating another embodiment of the control method in accordance with the present invention.

Next, an embodiment of another control method is illustrated in FIG. 9. FIG. 9 shows a case in which an output from the discharge pressure sensor 10 and an output from the refrigerant composition sensor 11 are considered when a control target value of a discharge gas temperature is determined. That is, the control target value of the discharge gas temperature is determined as a function of the discharge pressure. When the refrigerant superheatedness of the compressor discharge section is controlled, the superheatedness is computed on the basis of the difference between the discharge gas temperature and the computed refrigerant saturation temperature, while a refrigerant superheatedness target value is determined also by taking the refrigerant composition into consideration, and controlled by the liquid by-pass control valve 6 on the basis of the difference between the two superheatedness.

Figure 10:
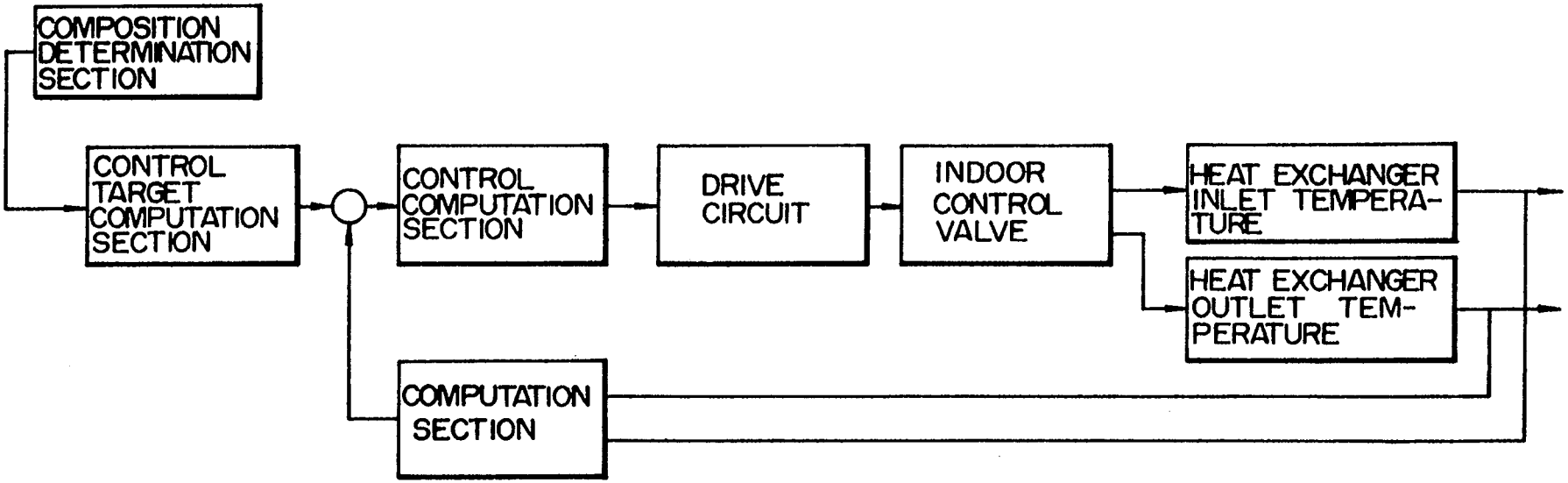
FIG. 10 is a control block diagram illustrating another embodiment of a method of controlling indoor machines.
Figure 11:
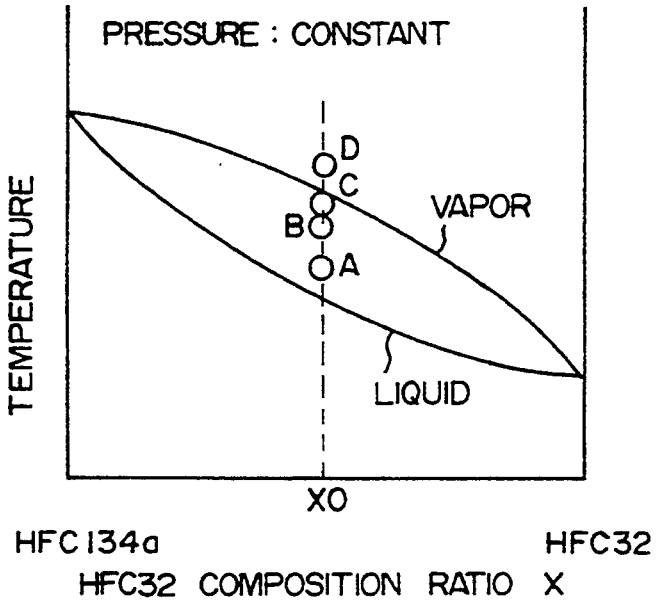
FIG. 11 is a diagram illustrating temperature changes inside an evaporator.

Next, another embodiment of a method of controlling the indoor machines is shown in FIG. 10. FIG. 10 illustrates a method of controlling the refrigerant outlet state of the indoor heat exchanger 111 which serves as an evaporator. FIG. 11 shows the relationship between the refrigerant composition and temperature, in which figure how the temperature of the refrigerant changes within the evaporator. Point A indicates the inlet of the indoor heat exchanger 111. Points B, C, and D indicate the states of the outlets thereof; point B indicates a wet state in which a liquid enters the outlet of the indoor heat exchanger 111; point C indicates the saturated state; and point D indicates a superheated state. Therefore, the temperatures of the refrigerant at the inlet and outlet of the indoor heat exchanger 111 are detected by the temperature sensors 141 and 131 shown in FIG. 6, and the difference between both temperatures is controlled, so that the outlet of the indoor heat exchanger 111 can be set to a wet or superheated state as desired. The composition of the circulating refrigerant should preferably be considered when the control targets of the refrigerant temperatures of the inlet and outlet of the indoor heat exchanger 111 are set, as shown in FIG. 10.

Figure 12:
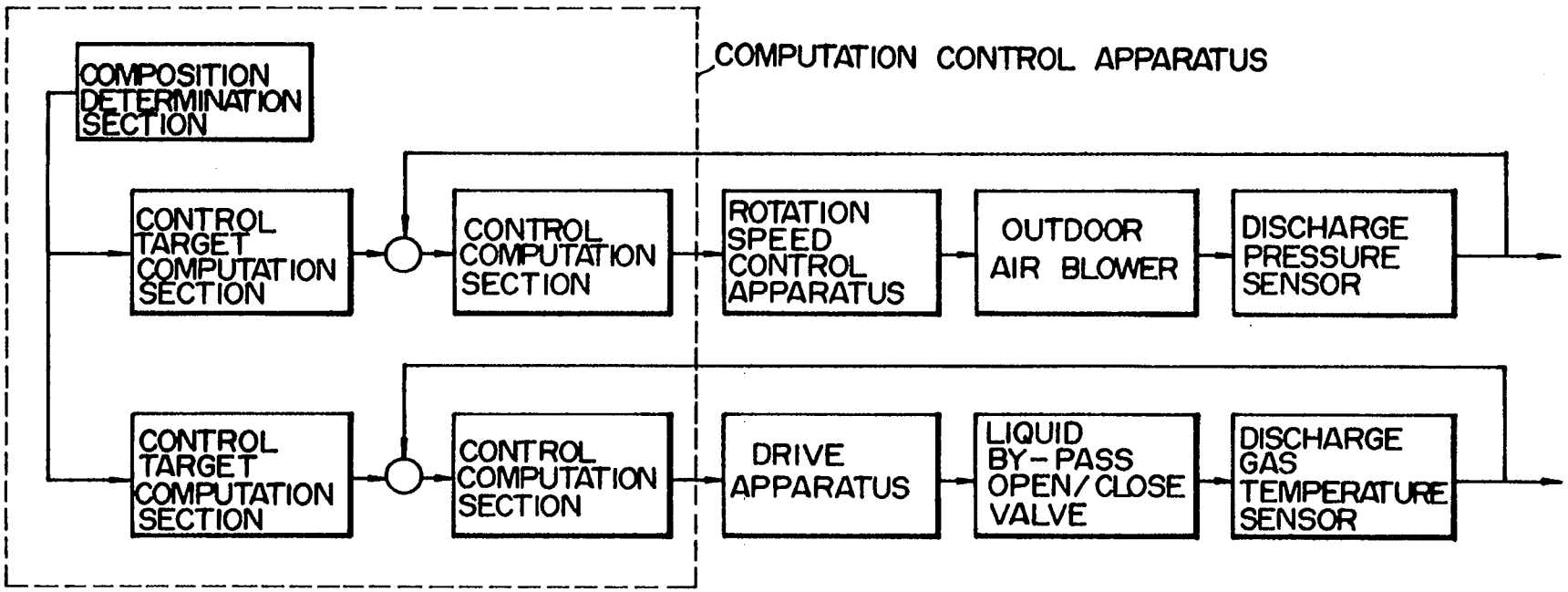
FIG. 12 is a control block diagram illustrating still another embodiment of a method of controlling indoor machines.

Next, another embodiment of the method controlling the outdoor machines is shown in FIG. 12. In FIG. 12, the discharge pressure is controlled by the rotation speed of the outdoor air blower 8. When the discharge pressure decreases, the rotation speed of the outdoor air blower 8 decreases, thereby preventing the discharge pressure from decreasing. In this case also, the composition of the refrigerant should preferably be considered when the control target value of the discharge pressure is determined. The rotation speed of the outdoor air blower 8 may be continuous or step-like. The lower portion of FIG. 12 indicates another embodiment of discharge gas temperature control, in which it is possible to use an open/close valve in place of the liquid by-pass control valve 6.

Figure 13:
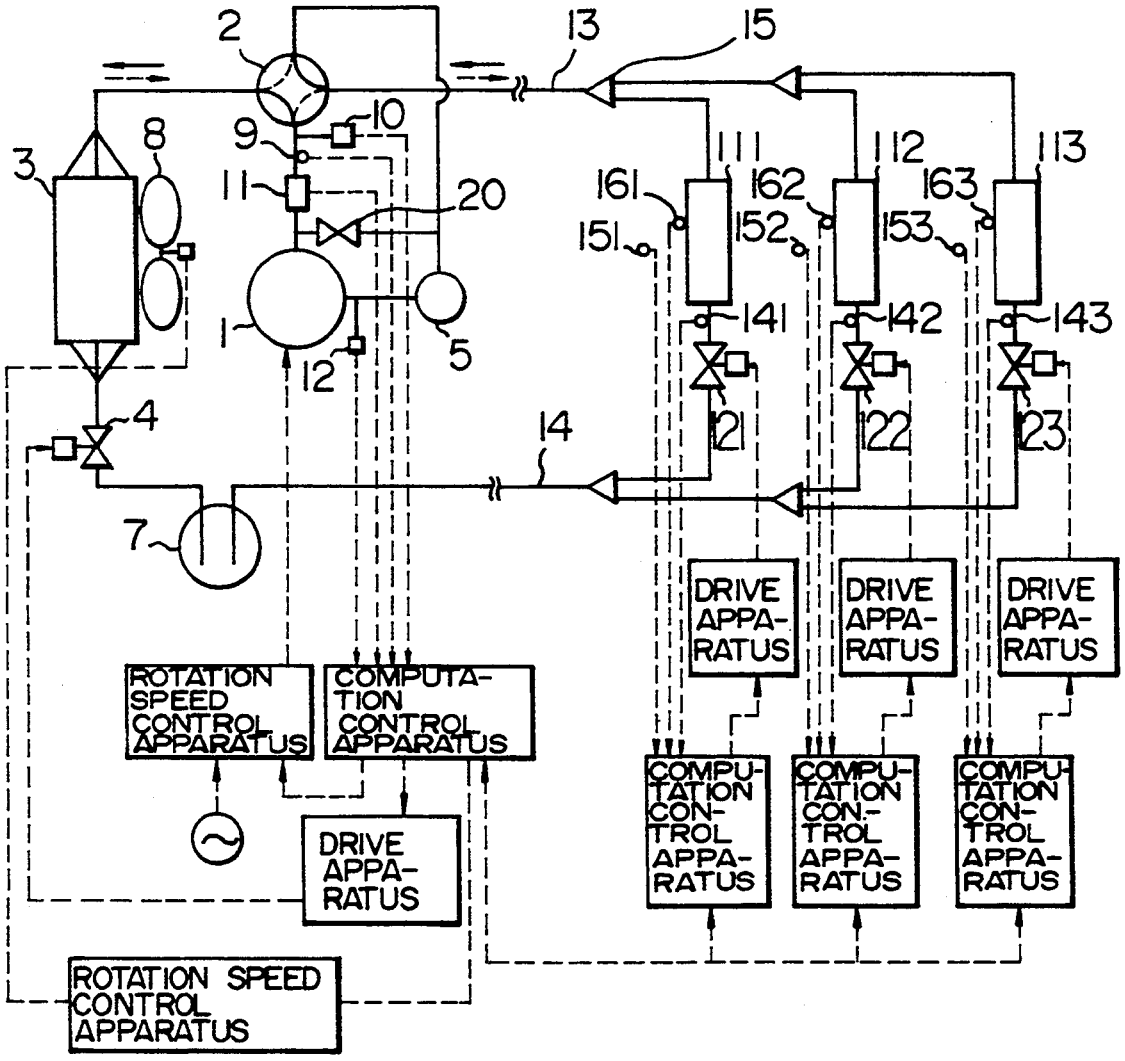
FIG. 13 is an illustration of the construction of a refrigeration cycle in accordance with another embodiment of the present invention, in which a plurality of indoor machines are connected.

Next, FIG. 13 illustrates another embodiment of the refrigeration cycle in which a plurality of indoor machines are connected to one outdoor machine. Components in FIG. 13 having the same reference numerals as those in FIG. 6 are identical components. Reference numerals 161, 162 and 163 denote temperature sensors for detecting the temperature of heat transfer tubes of an indoor heat exchanger. The refrigerant circulates in the direction of the solid-line arrow during a cooling operation, and circulates in the direction of the dashed-line arrow during a heating operation.

Figure 14:
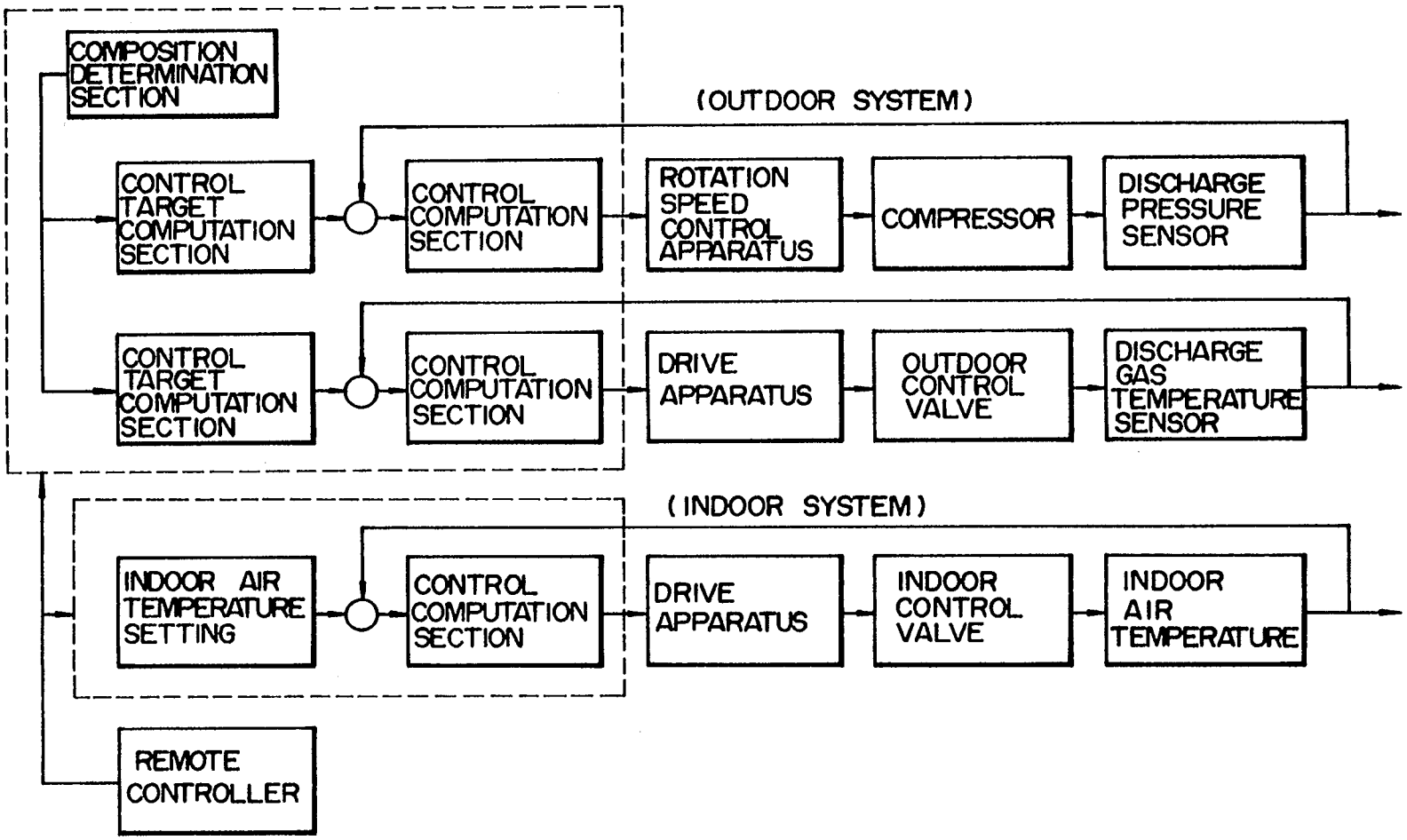
FIG. 14 is a control block diagram illustrating an embodiment of the present invention.

Next, FIG. 14 shows a control block diagram. A control method during the heating operation will be explained below with reference to FIGS. 13 and 14.

Initially, the discharge pressure of the compressor 1 is controlled by the rotation speed of the compressor 1. The control target is determined in accordance with the composition of the circulating refrigerant, the control computation section computes the rotation speed of the compressor 1 on the basis of the difference between the pressure detected by the discharge pressure sensor 10 and the control target by executing a prestored control program, and the rotation speed is sent out to the rotation speed control apparatus, the compressor 1 is operated on the basis of an output from the rotation speed control apparatus. Next, the control target value of the discharge gas temperature is also determined by taking the composition of the circulating refrigerant into consideration and controlled by the outdoor control valve 4. The control computation section computes an opening correction value of the outdoor control valve 4 on the basis of the difference between the value detected by the discharge gas temperature sensor 9 and the control target value by executing a prestored control program, and the value is sent out to the drive apparatus. The outdoor control valve 4 is operated by the drive apparatus, and the discharge gas temperature is determined on the basis of the characteristics of the refrigeration cycle.

Next, each of the indoor machines computes an opening correction value of the indoor control valve 121 on the basis of the difference between an indoor air temperature set value from the remote controller and the temperature detected by the indoor air temperature sensor 151 by executing a prestored control program, and the value is sent out to the drive apparatus. The drive apparatus actuates the indoor control valve 121, so that heating performance appropriate for the indoor heating load state is reached and the indoor air temperature stabilizes at the set value.

Figure 15:
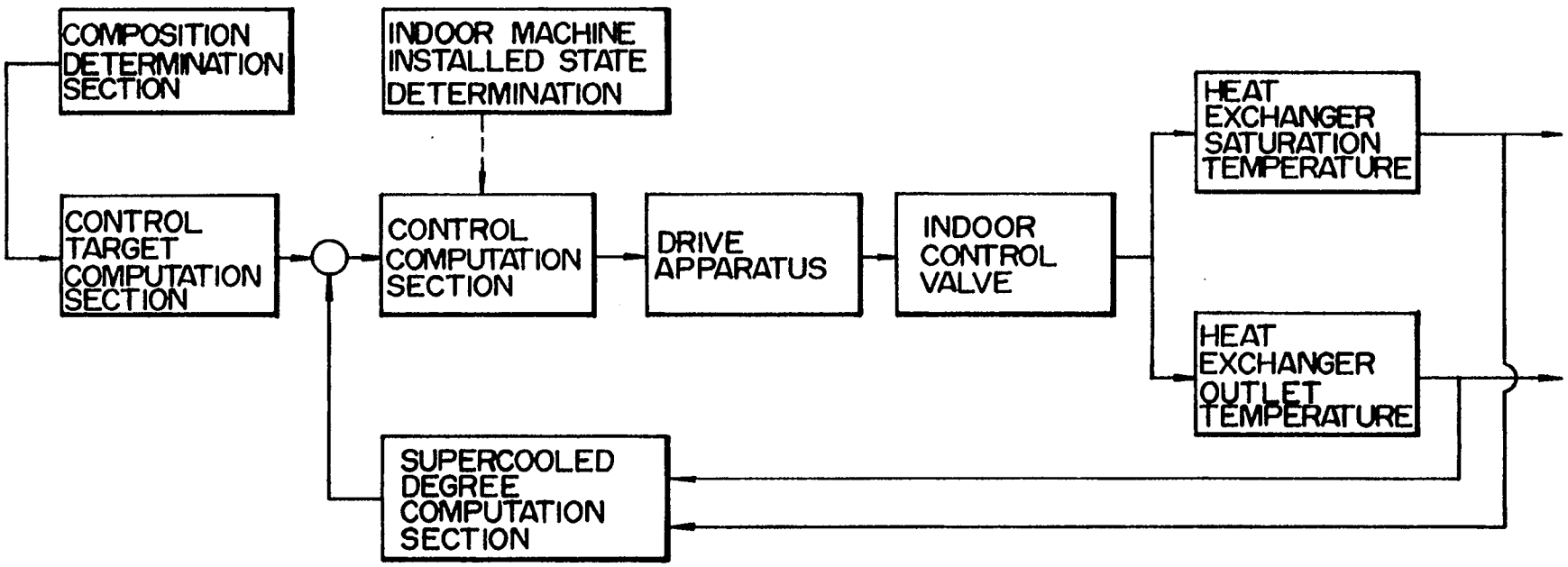
FIG. 15 is a control block diagram illustrating another embodiment of a method of controlling indoor machines.

Next, FIG. 15 illustrates another embodiment of a method of controlling the indoor control valve 121. The refrigerant saturation temperature of the indoor heat exchanger is detected by the temperature sensor 161, and the temperature of the indoor heat exchanger outlet is detected by the temperature sensor 141. The supercooledness is computed on the basis of the difference between both temperatures, and the control target value of the supercooledness is determined by the control target computation section in accordance with the refrigerant circulation composition. The control computation section computes an opening correction value of the indoor control valve 121 on the basis of the difference between the supercooledness computed value and the control target value by executing a prestored control program, and the value is sent out to the drive apparatus. Although in this embodiment the saturation temperature of the refrigerant is determined on the basis of the temperature of the indoor heat exchanger, it is also possible to determine the saturation temperature on the basis of pressure by using a pressure sensor.

Figure 16:
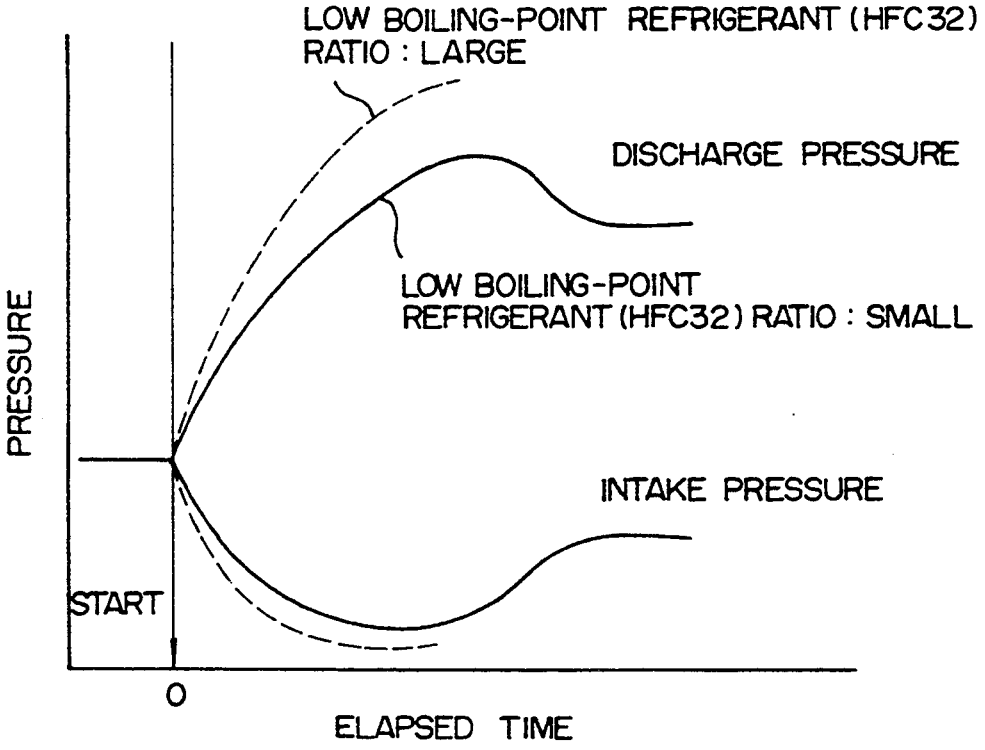
FIG. 16 is a diagram illustrating variation of pressure with respect to time at start time.

In the above description, a feedback control method mainly in a steady state has been explained. An embodiment of control during a non-steady operation will be explained below. FIG. 16 illustrates varying patterns of pressure with respect to time at start time. The discharge pressure increases after starting, and stabilizes at a steady pressure after overshooting. In contrast, the intake pressure decreases after starting, and stabilizes at a steady pressure after undershooting. When the composition of the low boiling-point refrigerant is larger from among the compositions of the circulating refrigerant, as shown in FIG. 16, there is a possibility that the discharge pressure overshoots more.

A state in which the composition ratio of the circulating refrigerant having a low boiling point is large occurs when the refrigerant in the liquid portion leaks outside, and occurs also when the low boiling-point refrigerant is gasified when the low-pressure side pressure decreases at start-up time. Therefore, it is necessary to consider the composition of the refrigerant also for control during a non-steady operation such as at start-up time.

An explanation will be given below of a method of controlling the refrigeration cycle shown in FIG. 13.

Figure 17:
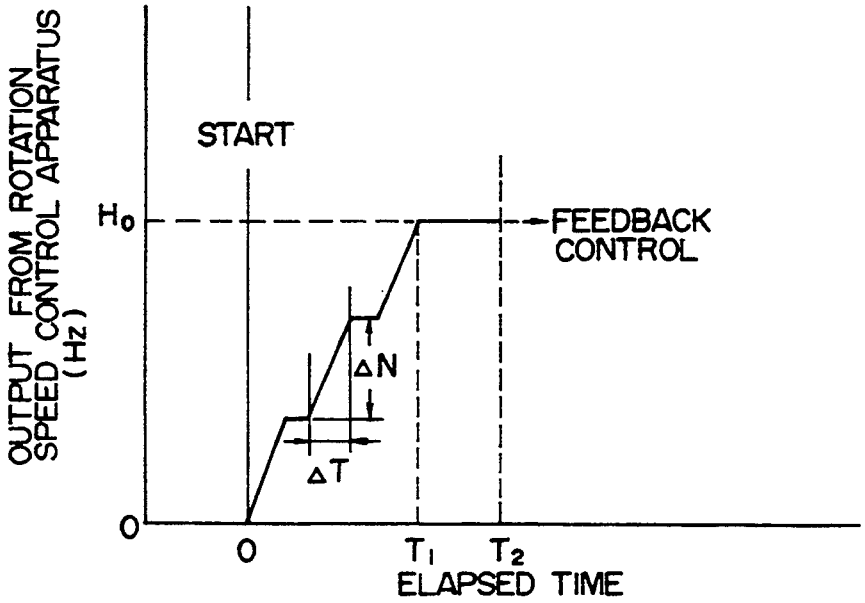
FIG. 17 is a diagram illustrating an example of a start speed of an apparatus for controlling the number of rotations of the compressor.
Figure 18:
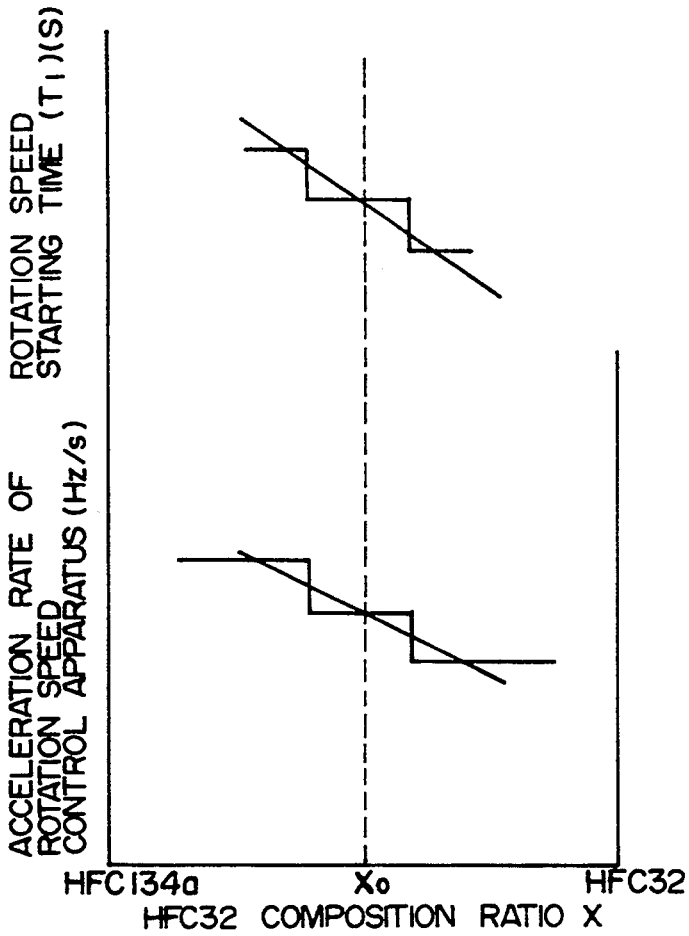
FIG. 18 is a diagram showing an example of the relationship between a start speed of an apparatus for controlling the number of rotations of the compressor and the composition ratio of the refrigerant.

FIG. 17 illustrates an embodiment related to the starting of the rotation speed of the compressor. The rotation speed of the compressor 1 is gradually increased in response to the start instruction in such a way that the rotation speed is increased at a speed of $\Delta N/\Delta T$ shown in FIG. 17 from a certain rotation speed up to a certain rotation speed, and as a whole increased up to N0 in an elapsed time T1, as shown in FIG. 17. FIG. 18 illustrates an embodiment of the relationship between the increasing speed of the rotation speed and the composition of the refrigerant. When the composition ratio of the low boiling-point refrigerant is large, it is necessary to gradually increase the rotation speed. As a result, an abnormal increase in the discharge pressure at start time shown in FIG. 16 can be prevented. In this embodiment, the relationship between the increasing speed of the rotation speed and the composition of the refrigerant may be continuous and step-like, as shown in FIG. 18.

Figure 19:
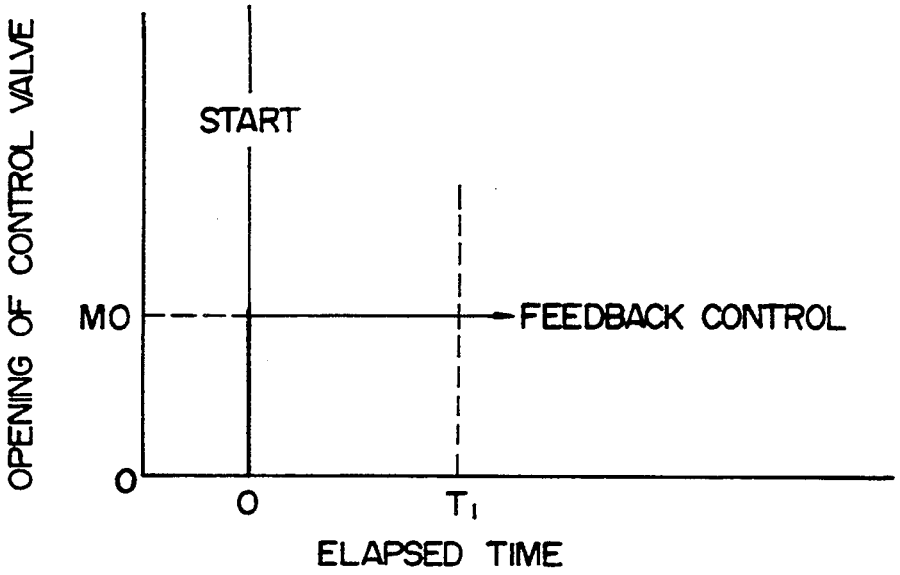
FIG. 19 is an illustration of an initial set value of a control valve.

Next, FIG. 19 is an illustration of an initial set value of the control valve. As shown in FIG. 19, the control valve, upon starting, is set at a certain initial opening, and the control shifts to feedback control after a certain time has elapsed. The opening of the control valve may be shifted sequentially by the time the control shifts to feedback control. The opening of the control valve until the control shifts to feedback control is determined to be an initial opening, and the initial opening must be varied in accordance with the composition of the refrigerant.

Figure 20:
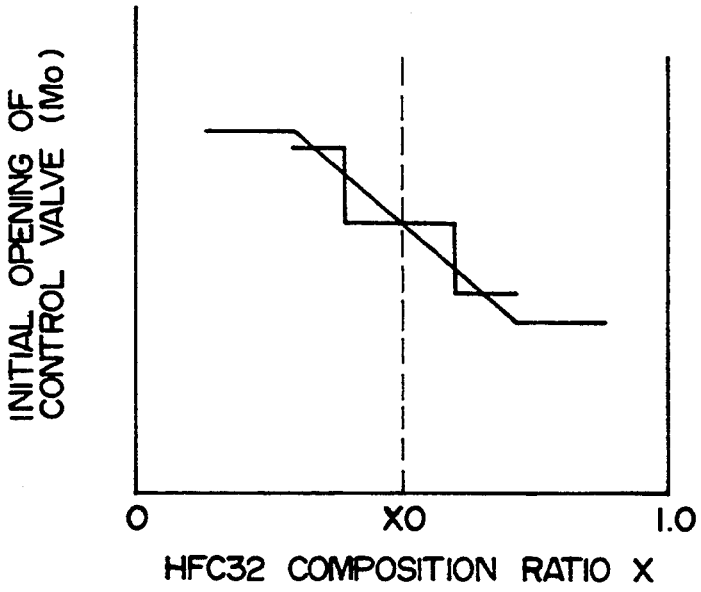
FIG. 20 is a diagram showing an example of the relationship between an initial set value of the control valve and the composition ratio of the refrigerant.

FIG. 20 illustrates an embodiment of the composition of the refrigerant and the initial opening. The larger the composition ratio of the low boiling-point refrigerant, the smaller the initial opening must be made. However, in an area where the composition ratio of the low boiling-point refrigerant is large or small, an upper or lower limit may be provided, respectively, as shown in FIG. 20. Also, the relationship between the initial opening and the composition of the refrigerant may be continuous and step-like, as shown in FIG. 20.

Figure 21:
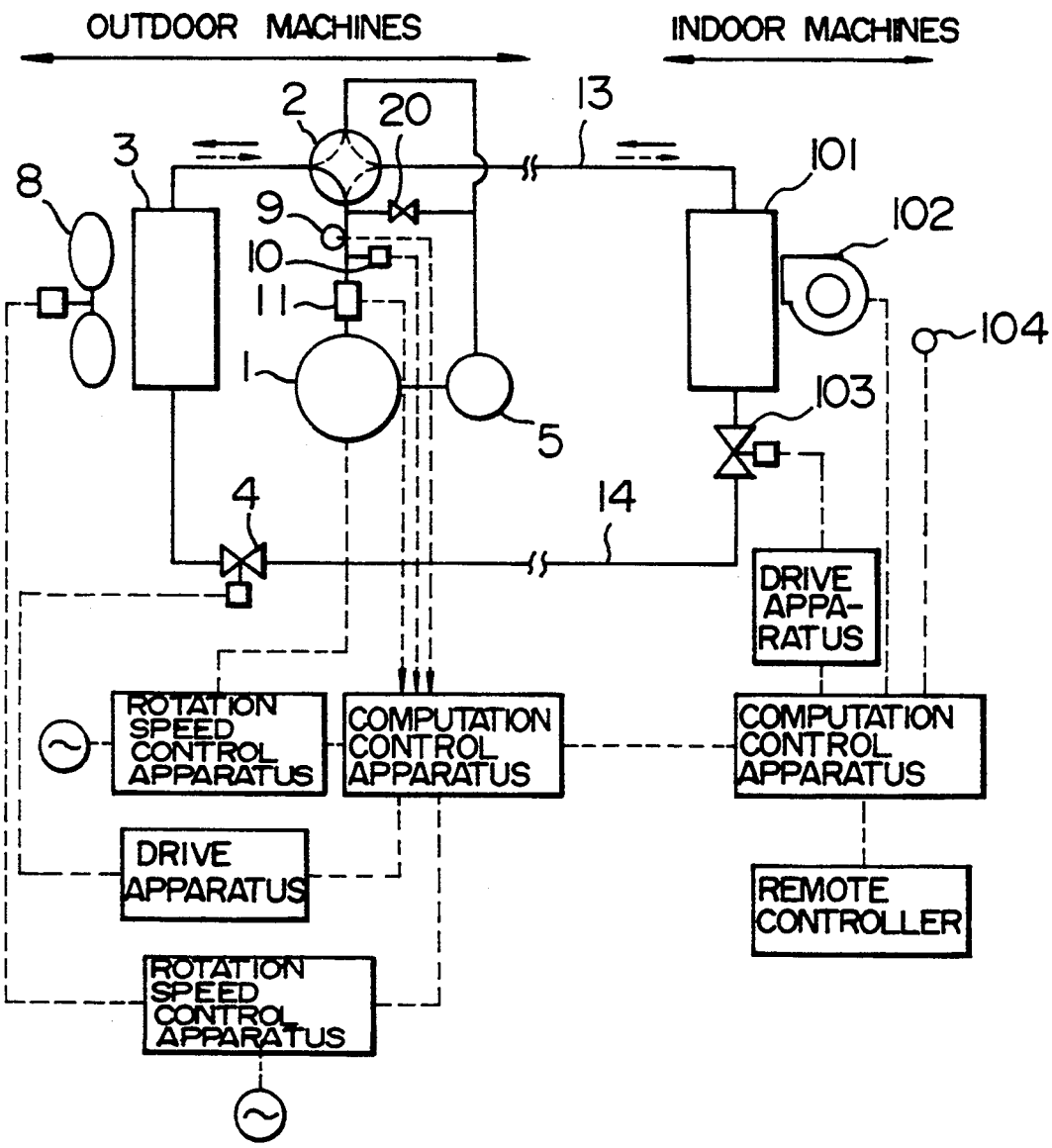
FIG. 21 is an illustration of the construction of a refrigeration cycle having one indoor machine provided therein, in accordance with another embodiment of the present invention.

In the above description, the refrigeration cycle in which a plurality of indoor machines are connected to one outdoor machine has been explained. The control method described for the refrigeration cycle in which a plurality of indoor machines are connected, which has been explained with reference to FIG. 20 or previous figures, can also be applied to the refrigeration cycle, shown in FIG. 21, in which one indoor machine is connected to one outdoor machine. Components in FIG. 21 having the same reference numerals as those in FIG. 6 are identical components. Reference numeral 20 denotes an open/close valve for bypassing hot gas; reference numeral 21 denotes an open/close valve for bypassing liquid; reference numeral 101 denotes an indoor heat exchanger; reference numeral 102 denotes an indoor air blower; reference numeral 103 denotes an indoor control valve; and reference numeral 104 denotes an indoor air temperature sensor. The compressor 1 is a compressor whose rotation speed is controlled. The control system, on the outdoor machine side, comprises a computation control apparatus for performing signal conversion and computation, a compressor rotation speed control apparatus, a drive apparatus for the outdoor control valve 4, and a rotation speed control apparatus for the outdoor air blower 8. The control system, on the indoor machine side, comprises a computation control apparatus for performing signal conversion and computation, an apparatus for driving the indoor control valve 103, and a remote controller. In FIG. 21, the refrigerant circulates in the direction of the solid-line arrow during a cooling operation, and circulates in the direction of the dashed-line arrow during a heating operation.

Figure 22:
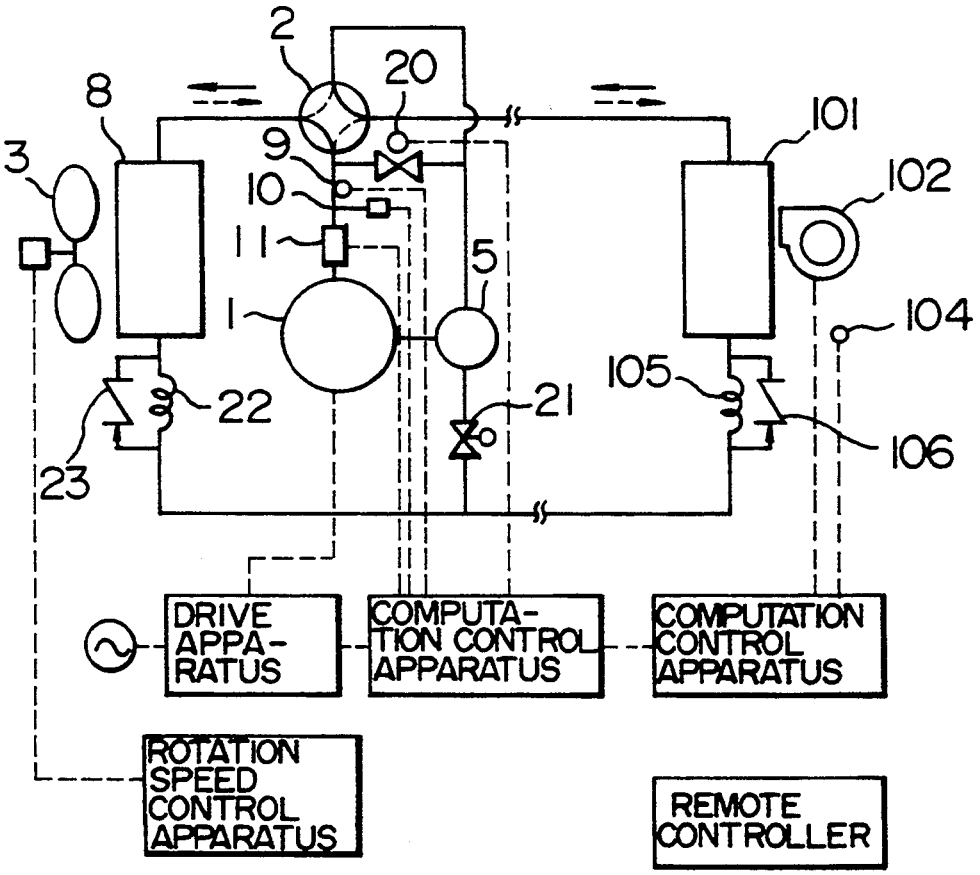
FIG. 22 is an illustration of the construction of a refrigeration cycle having one indoor machine provided therein, in accordance with still another embodiment of the present invention.

Next, FIG. 22 illustrates another embodiment of the refrigeration cycle in which one indoor machine is connected.

Components in FIG. 22 having the same reference numerals as those in FIG. 6 are identical components. In FIG. 22, reference numerals 22 and 106 denote capillary tubes; and reference numerals 23 and 106 denote check valves. In this embodiment, the compressor 1 is a compressor driven by a commercial power supply. The control system, on the outdoor machine side, comprises a computation control apparatus for performing signal conversion and computation, a compressor drive circuit which is an electromagnetic switch, and an apparatus for controlling the rotation speed of the outdoor air blower 8. The control system, on the indoor machine side, comprises a computation control apparatus for performing signal conversion and computation, and a remote controller. In FIG. 22, the refrigerant circulates in the direction of the solid-line arrow during a cooling operation, and circulates in the direction of the dashed-line arrow during a heating operation. A necessity when the refrigeration cycle shown in FIG. 22, in which the compressor is driven by a commercial power supply, is controlled, is the consideration for an increase in the discharge pressure when the composition ratio of the low boiling-point refrigerant becomes large from among the compositions of the mixture refrigerant.

Figure 23:
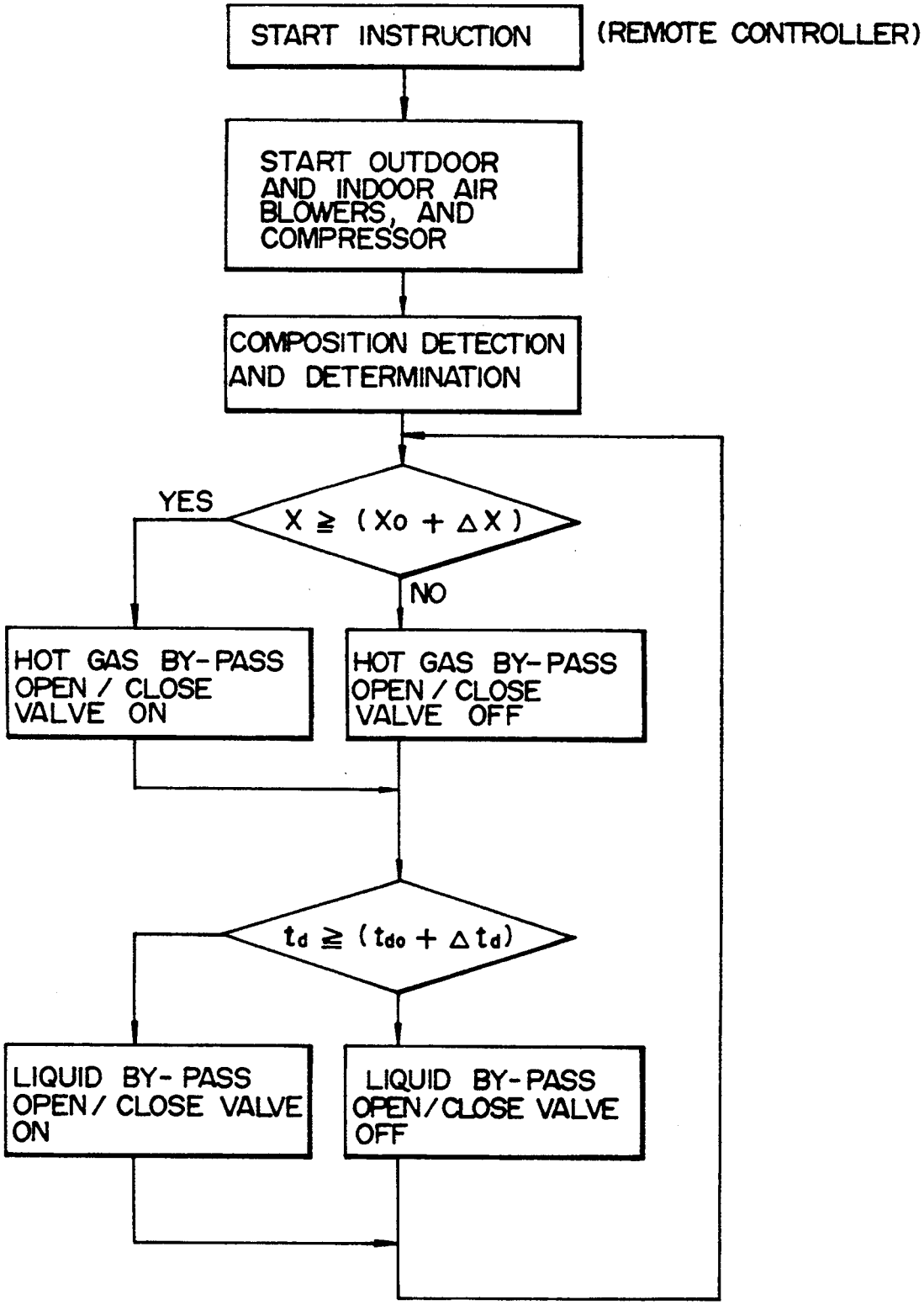
FIG. 23 is a flowchart showing the control flow from the time when the refrigeration cycle is started.

FIG. 23 shows a control flowchart from the time when the refrigeration cycle is started. When a start instruction is issued to the computation control apparatus from the remote controller, the outdoor air blower 8, the indoor air blower 102 and the compressor 1 are started. Thereafter, the composition of the refrigerant is determined. When the composition ratio of the low boiling point refrigerant is large, the open/ close valve 20 for bypassing hot gas is opened so as to return a part of the refrigerant discharged from the compressor to the intake side, thereby preventing an abnormal increase in the discharge pressure. When the composition ratio of the low boiling-point refrigerant is large only in the non-steady state, the hot gas bypass open/close valve 20 is closed if the composition of the refrigerant stabilizes at the designed composition. However, when the liquid refrigerant leaks outside and the composition ratio of the low boiling-point refrigerant is large in the steady state, it is necessary to allow the hot gas bypass open/close valve 20 to be left opened. However, if it is left opened, the discharge gas temperature of the compressor 1 and the motor coil temperature increase. Therefore, it is necessary to open the liquid bypass open/close valve 21 to return a part of the high-pressure liquid to the intake side in order to cool it. Although in FIG. 23 the composition of the refrigerant is detected and determined after the air blower and the compressor are started, the composition of the refrigerant may be detected and determined before they are started.

Figure 24:
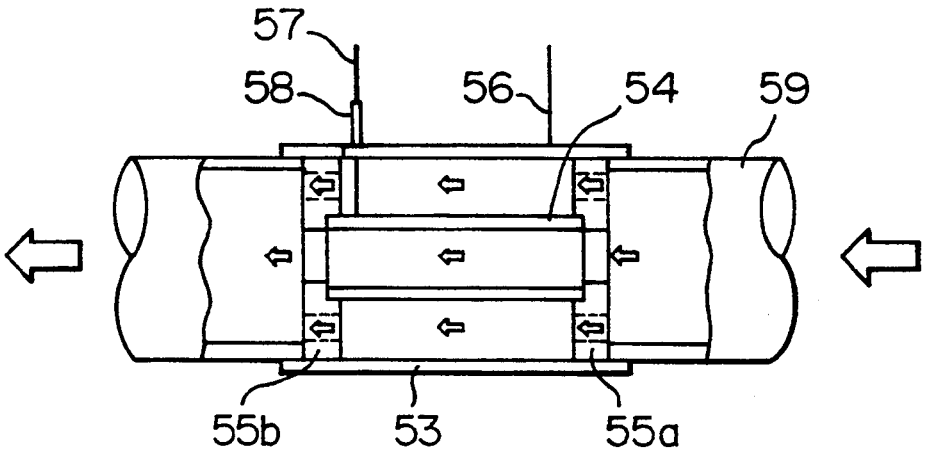
FIG. 24 is a sectional view illustrating an electrostatic capacitance sensor type composition sensor shown in FIG. 6.

In the above description, the method of controlling the refrigeration cycle in which a non-azeotrope refrigerant is used has been explained. Next, an explanation will be given of an embodiment of the construction of the electrostatic capacitance type sensor 11 for detecting the composition of a mixture refrigerant. FIG. 24 is a sectional view of an embodiment of the electrostatic capacitance type sensor 11 shown in FIG. 6. In FIG. 24, reference numeral 53 denotes an outer tube electrode, and reference numeral 54 denotes an inner tube electrode, both of which are hollow tubes. The inner tube electrode 54 is formed in such a way that both ends thereof are fixed by stoppers 55*a* and 55*b* having the size of approximately the inner diameter of the outer tube electrode 53, in which a circular groove is provided so as to fix the inner tube electrode 54 in the central portion of the outer tube electrode 53, the stoppers 55*a* and 55*b* are fixed by a refrigerant guide tube 59 having an outer diameter of approximately the inner diameter of the outer tube electrode 53, and the refrigerant guide tube 59 is fixed to the outer tube electrode 53. As a result, the inner tube electrode 54 is fixed to the central portion of the outer tube electrode 53. An outer-tube electrode signal line 56 and an inner-tube electrode signal line 57 are connected to the outer tube electrode 53 and the inner tube electrode 54, respectively, in order to detect an electrostatic capacitance value. A signal line guide tube 58 (e.g., a hermetic terminal) for guiding the inner-tube electrode signal line 57 to the outside of the outer tube electrode 53 and for preventing the refrigerant inside from escaping to the outside, are disposed outside the inner-tube electrode signal line 57. In the stoppers 55*a* and 55*b*, at least one through passage having a size smaller than the inner diameter of the inner tube electrode 54 is disposed in the central portion thereof, and at least one passage for the refrigerant is disposed at a place between the inner tube electrode 54 and the outer tube electrode 53, so that the flow of the mixture refrigerant flowing through the inside is not obstructed.

Figure 25:
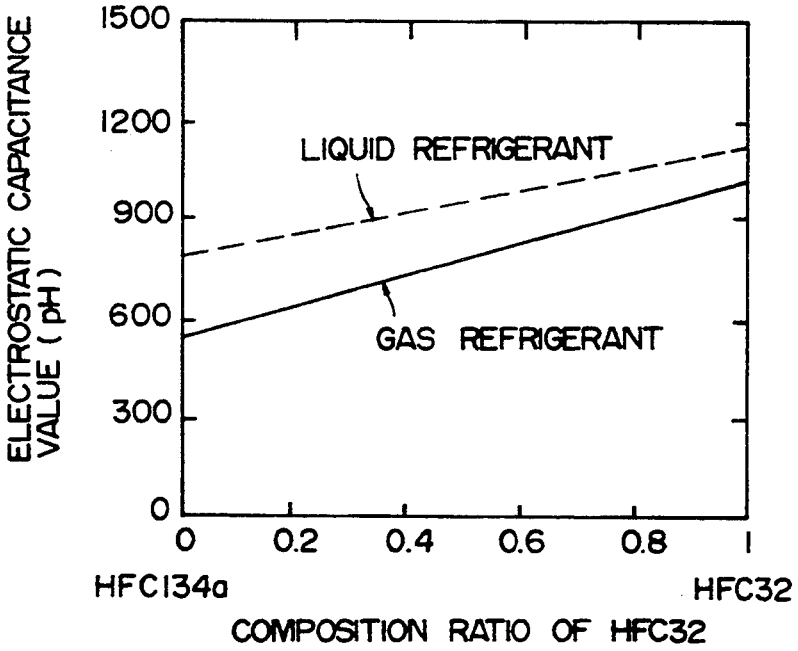
FIG. 25 is a diagram illustrating the relationship between the composition of the mixture refrigerant and the electrostatic capacitance value.

Next, an explanation will be given of a method of detecting the composition of a mixture refrigerant by using the electrostatic capacitance type composition sensor 11. FIG. 25 illustrates the relationship between the composition of the refrigerant and the electrostatic capacitance value when the electrostatic capacitance sensor is used FIG. 25 illustrates measured values obtained when HFC134a is used as a high boiling-point refrigerant and HFC32 is used as a low boiling-point refrigerant from among the mixture refrigerant and they are sealed in the composition sensor shown in FIG. 24 as gas and liquid, respectively. The horizontal axis indicates the composition ratio of the HFC32, and the vertical axis indicates the electrostatic capacitance value which is an output from the composition sensor 11. In FIG. 25, a comparison of the electrostatic capacitance value of gas of each refrigerant with that of liquid of each refrigerant shows that the liquid refrigerant has a larger value, and the difference between the electrostatic capacitance value of gas and that of liquid is large, in particular, in the HFC134a. This indicates that the electrostatic capacitance value varies when the dryness of the refrigerant varies. In contrast, a comparison between the electrostatic capacitance values of HFC134a and HFC32 shows that HFC32 has a larger electrostatic capacitance value for both liquid and gas. This indicates that only a gas or liquid refrigerant exists in the composition sensor 11, and when the composition of the refrigerant varies, the electrostatic capacitance value varies. However, since the inside of the composition sensor 11 enters a two-phase state of gas and liquid, the electrostatic capacitance value varies due to the dryness of the refrigerant in addition to the composition of the mixture refrigerant on account of the characteristics of the former, it becomes impossible to detect the composition. Therefore, when the composition of the mixture refrigerant is detected by using the composition sensor 11, it is necessary to dispose the composition sensor 11 in a portion where the refrigerant is always gas or liquid in the refrigeration cycle. Although in the embodiments of the present invention the composition sensor 11 is disposed in the compressor outlet of the refrigeration cycle, it may be disposed in a portion where the refrigerant is always gas or liquid in the refrigeration cycle. Means other than the electrostatic capacitance type may be used for the composition detecting means when the present invention is carried out.

Figure 26:
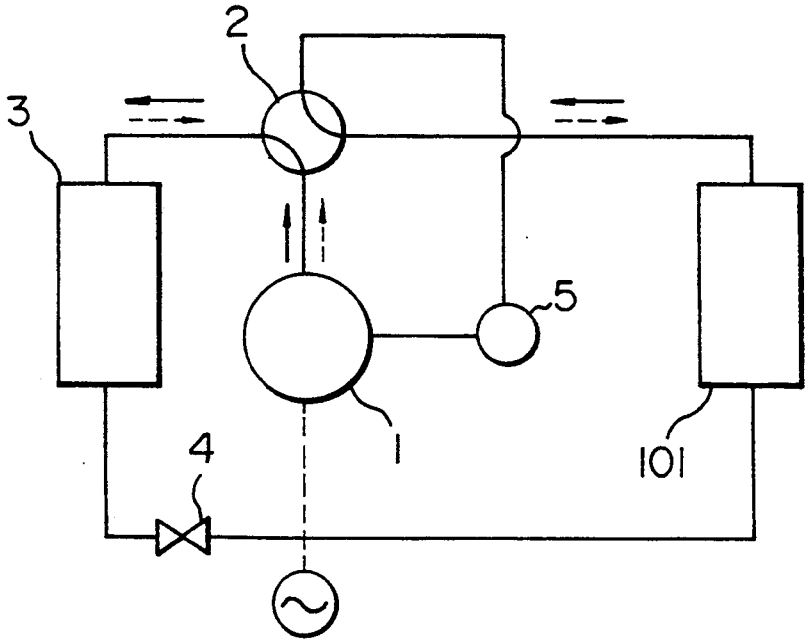
FIG. 26 is an illustration of the construction of a refrigeration cycle in which the compressor is driven by a commercial power supply.
Figure 27:
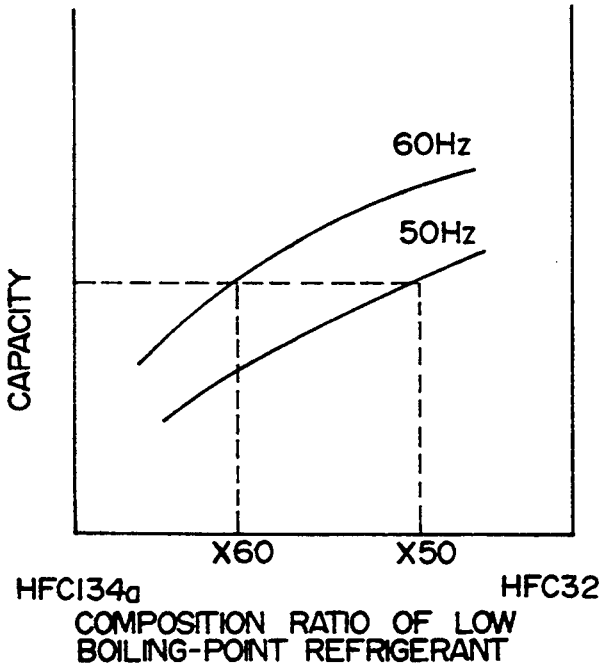
FIG. 27 is a diagram illustrating the relationship among the composition ratio of the mixture refrigerant, the frequency of the commercial power supply, and performance.

Next, an embodiment in accordance with a second aspect of the present invention will be explained. FIG. 26 illustrates a refrigeration cycle having a compressor driven by a commercial power supply, in which a non-azeotrope refrigerant is used. Components in FIG. 26 having the same reference numerals as those in FIG. 21 are identical components. The refrigerant circulates in the direction of the solid-line arrow during a cooling operation, and circulates in the direction of the dashed-line arrow during a heating operation. FIG. 27 illustrates the relationship between the composition ratio of a low boiling-point refrigerant of a non-azeotrope refrigerant and capacity, using the rotation speed of a compressor as a parameter. It can be seen from FIG. 27 that the greater the rotation speed of the compressor is, the greater the capacity becomes at the same composition ratio of the refrigerant. In Japan, there are areas where the frequency of the commercial power supply is 50 or 60 Hz. Therefore, the capacity is smaller in the area of 50 Hz in the same refrigeration cycle. Thus, if the composition ratio of the low boiling-point refrigerant is increased in the area of 50 Hz and if the composition ratio of the low boiling-point refrigerant is decreased in the area of 60 Hz, capacity can be made the same regardless of the frequency of the power supply.

To vary the composition ratio of a sealed-in refrigerant, first a refrigerant of a high boiling-point, e.g., HFC134a, may be put a predetermined amount from a bomb, and thereafter a refrigerant of a low boiling-point point, e.g., HFC32, may be put a predetermined amount.

According to the present invention, since the composition of a refrigerant circulating in a refrigeration cycle is detected and determined, and control appropriate for the detected composition is performed, a stable operation becomes possible even when the composition of the refrigerant circulating in the refrigeration cycle varies from a designed composition of the refrigeration cycle because of the leakage of the refrigerant to the outside or variations in the composition when the composition is sealed in. Furthermore, when the composition of the refrigerant varies in a non-steady state of the refrigeration cycle, a high-performance and highly reliable operation is possible.

In addition, according to the second aspect of the present invention, it is possible to make the capacity the same regardless of the frequency of the commercial power supply. Since the heating capacity increases, in particular, in the area where the frequency of the commercial power supply is 50 Hz, comfortableness and power saving are possible.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the claims. The following claims are to be accorded the broadest interpretation, so as to encompass all such modifications and equivalent structures and functions.

What is claimed is:

1. A refrigeration cycle, comprising a compressor; a heat-source side heat exchanger; a use-side heat exchanger; a refrigerant pressure reducing apparatus; a non-azeotrope refrigerant; and detecting means for detecting a value of the composition of the non-azeotrope refrigerant; said control apparatus controlling said compressor and said refrigerant pressure reducing apparatus based on the detected value of the composition of the non-azeotrope refrigerant.

2. A refrigeration cycle according to claim 1, wherein said control apparatus operates and controls the refrigeration cycle on the basis of a control target value corresponding to the value detected by said detecting means.

3. A refrigeration cycle according to claim 2, wherein said control target value is pressure of the refrigeration cycle.

4. A refrigeration cycle according to claim 2, wherein said control target value is temperature of the refrigeration cycle.

5. A refrigeration cycle according to claim 1, wherein said control apparatus changes a control target value of said control apparatus when it is determined that said detection value is varied.

6. A refrigeration cycle according to claim 1, wherein said control apparatus sets a predetermined fixed value for said compressor and said refrigerant pressure reducing apparatus which serve as control actuators to a value corresponding to the detected value of the composition of the non-azeotrope refrigerant.

7. A refrigeration cycle according to claim 1, wherein said control apparatus prestores the designed composition of the non-azeotrope refrigerant which is sealed in the refrigeration cycle, and said control apparatus changes a control target value of said control apparatus when said control apparatus determines that the detected value of the composition of the non-azeotrope refrigerant, detected by said detecting means, has varied with respect to said initial composition.

8. A refrigeration cycle according to claim 1, wherein said detecting means detects the initial composition of the non-azeotrope refrigerant which is sealed in the refrigeration cycle, and said control apparatus stores said initial composition and changes a control target value of said control apparatus when said control apparatus determines that the detected value of the composition of the non-azeotrope refrigerant, detected by said detecting means, is varied with respect to said initial composition.

9. A refrigeration cycle according to claim 1, wherein said control apparatus prestores the designed composition of the non-azeotrope refrigerant which is sealed in the refrigeration cycle, said control apparatus operates and controls the refrigeration cycle by comparing the detected value of the composition of the non-azeotrope refrigerant, detected by said detecting means after the refrigeration cycle is operated, with said designed composition, to determine a predetermined fixed value for said compressor, said refrigerant pressure reducing apparatus or the like which serve as control actuators.

10. A refrigeration cycle according to claim 1, wherein said detecting means detects the initial composition of the composition of a non-azeotrope refrigerant which is sealed in the refrigeration cycle, and said control apparatus stores the detected initial composition and operates and controls the refrigeration cycle by comparing the detected value of the composition of the non-azeotrope refrigerant, detected by said detecting means after the refrigeration cycle is operated, with said designed composition, to determine a predetermined fixed value for said compressor, said refrigerant pressure reducing apparatus, or the like which serves as control actuators, on the basis of the difference between the compositions.

11. A refrigeration cycle according to claim 1, wherein a plurality of use-side units formed of a use-side heat exchanger, a refrigerant pressure reducing apparatus are connected to said heat-source side unit formed of a compressor, a heat-source side heat exchanger, a refrigerant pressure reducing apparatus or the like, and a non-azeotrope refrigerant is used as a working fluid.

12. A refrigeration cycle according to claim 1, wherein said detecting means is an electrostatic capacitance sensor.

13. A refrigeration cycle according to claim 1, wherein said detecting means is an electrostatic capacitance sensor disposed in a gas refrigerant fluid section of the refrigeration cycle.

14. A refrigeration cycle, comprising a rotation speed variable compressor; a heat-source side heat exchanger; a use-side heat exchanger; and a refrigerant pressure reducing apparatus, a non-azeotrope refrigerant as a working fluid;

detecting means for detecting a value of the composition of the non-azeotrope refrigerant; and a control apparatus for controlling rotation speed of said rotation speed variable compressor and said refrigerant pressure reducing apparatus on the basis of the detected value, wherein the rotation speed start speed from the time when the rotation speed variable compressor is started is set to a value corresponding to a detected value of the composition of the non-azeotrope refrigerant.

15. A refrigeration cycle, comprising a rotation speed variable compressor; a heat-source side heat exchanger; a use-side heat exchanger; and a resistance variable refrigerant pressure reducing apparatus, a non-azeotrope refrigerant as a work fluid detecting means for detecting a value of the composition of a non-azeotrope refrigerant; and a control apparatus for controlling said rotation speed variable compressor and said resistance variable refrigerant pressure reducing apparatus, wherein a predetermined resistance of said refrigerant pressure reducing apparatus is set to a value corresponding to the detected value of the composition of the non-azeotrope refrigerant, detected by said refrigerant composition detecting means, and the refrigeration cycle is operated and controlled by said control apparatus.

16. A refrigeration cycle, comprising a compressor; a heat-source side heat exchanger; a use-side heat exchanger provided with a value for controlling flow of a non-azeotrope refrigerant and a cooling fan; and a resistant variable refrigerant pressure reducing apparatus;

detecting means for detecting the composition of the non-azeotrope refrigerant; and a control apparatus for controlling said compressor, said refrigerant pressure reducing apparatus or the like, wherein said control apparatus controls the rotation speed of said compressor, the opening of said control valve, and the rotation speed of the said cooling fan on the basis of the detected value of the composition of the non-azeotrope refrigerant, detected by said detecting means.

17. A refrigeration cycle according to claim 16, wherein said control valve comprises a liquid bypass control valve and a hot gas bypass open/close valve.

* * * * *